US009951446B2

(12) United States Patent
Chen et al.

(10) Patent No.: US 9,951,446 B2
(45) Date of Patent: Apr. 24, 2018

(54) INFRARED TRANSPARENT VISIBLE OPAQUE FABRICS

(71) Applicants: Gang Chen, Carlisle, MA (US); Jonathan K. Tong, Cambridge, MA (US); Svetlana Boriskina, Winchester, MA (US); Xiaopeng Huang, Cambridge, MA (US); James Loomis, Boston, MA (US); Yanfei Xu, Cambridge, MA (US)

(72) Inventors: Gang Chen, Carlisle, MA (US); Jonathan K. Tong, Cambridge, MA (US); Svetlana Boriskina, Winchester, MA (US); Xiaopeng Huang, Cambridge, MA (US); James Loomis, Boston, MA (US); Yanfei Xu, Cambridge, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 15/461,055

(22) Filed: Mar. 16, 2017

(65) Prior Publication Data

US 2018/0030626 A1 Feb. 1, 2018

Related U.S. Application Data

(63) Continuation of application No. PCT/US2015/050720, filed on Sep. 17, 2015.

(Continued)

(51) Int. Cl.

*D03D 1/00* (2006.01)
*D03D 15/00* (2006.01)

(Continued)

(52) U.S. Cl.

CPC ..... *D03D 1/0035* (2013.01); *A41D 13/0053* (2013.01); *A41D 31/00* (2013.01); *D03D 15/0061* (2013.01); *A41D 2500/20* (2013.01); *D10B 2321/021* (2013.01); *D10B 2501/04* (2013.01)

(58) Field of Classification Search

CPC ..... B82Y 30/00; D04H 3/002; D03D 15/00; D03D 15/0061

See application file for complete search history.

(56) References Cited

U.S. PATENT DOCUMENTS 4,340,091 A * 7/1982 Skelton ..... A61F 2/06 139/383 R
2004/0116025 A1* 6/2004 Gogins ..... A62D 5/00 442/340

(Continued)

FOREIGN PATENT DOCUMENTS

WO 2014087161 A1 6/2014

OTHER PUBLICATIONS

Song, WF et al., Study on radiative heat transfer property of fiber assemblies using FTIR. Journal of Thermal Analysis and Calorimetry, 2010. 103(3): 785-790, in particular p. 786, figure 2.

(Continued)

*Primary Examiner* — Bobby Muromoto, Jr.
(74) *Attorney, Agent, or Firm* — Cooley LLP

(57) ABSTRACT

Infrared-transparent visible-opaque fabrics for wearable personal thermal management.

16 Claims, 30 Drawing Sheets

Related U.S. Application Data

(60) Provisional application No. 62/051,348, filed on Sep. 17, 2014.

(51) Int. Cl.
*A41D 31/00* (2006.01)
*A41D 13/005* (2006.01)

(56) References Cited

U.S. PATENT DOCUMENTS

2008/0170982 A1* 7/2008 Zhang ..... B82Y 10/00 423/447.3
2015/0147573 A1* 5/2015 Zhang ..... B82Y 10/00 428/408
2015/0308018 A1* 10/2015 Zhang ..... B82Y 10/00 156/167
2016/0083872 A1* 3/2016 Zhang ..... B82Y 10/00 264/164

OTHER PUBLICATIONS

Notification of Transmittal of the International Search Report and the Written Opinion, and the International Search Report and the Written Opinion, of the International Searching Authority in International Application No. PCT/US15/50720 dated Dec. 17, 2015, 7 pages.
ASTM D3995-14, Standard Performance Specification for Men's and Women's Knitted Career Apparel Fabrics: Dress and Vocational, printed Sep. 12, 2017, 4 pages.
Kaplan, S. et al., "Thermal Comfort Performance of Sports Garments with Objective and Subjective Measurements", Indian J. Fibre Text. Res., 2012, vol. 37, pp. 46-54.
Kayacan, O. et al., "Effect of Garment Design on Liquid Cooling Garments", Text. Res. J., 2010, vol. 80, pp. 1442-1455.
Kraemer, D. et al., "A Simple Differential Steady-State Method to Measure the Thermal Conductivity of Solid Bulk Materials with High Accuracy", Rev. Sci. Instrum. 2014, vol. 85, 025108-6.
Krimm, S. et al., "Infrared Spectra of High Polymers. II. Polyethylene", J. Chem. Phys. 1956, vol. 25, p. 549-562.
Laskarakis, A. et al., "Study of the Electronic and Vibrational Properties of Poly(ethylene Terephthalate) and Poly(ethylene Naphthalate) Films", J. Appl. Phys., 2007, vol. 101, 053503-1-9.
Loomis, J. et al., "Continuous Fabrication Platform for Highly Aligned Polymer Films", Technology, 2014, pp. 1-11.
Memon, S., "Phase Change Materials Integrated in Building Walls: A State of the Art Review", Renew. Sustain. Energy Rev., 2014, vol. 31, pp. 870-906.
Muir, I. et al., "Effects of a Novel Ice-Cooling Technique on Work in Protective Clothing at 28C, 23C, and 18C WBGTs", Am. Ind. Hyg. Assoc. J., 1999, vol. 60, pp. 96-104.
Nag, P. et al., " Efficacy of a Water-Cooled Garment for Auxiliary Body Cooling in Heat", Ergonomics, 1998, vol. 41, pp. 179-187.
Norvang, L. et al., "Skin Pigmentation Characterized by Visible Reflectance Measurements", Lasers Med. Sci., 1997, vol. 12, pp. 99-112.
Perez-Lombard, L. et al., "A Review on Buildings Energy Consumption Information", Energy Build, 2008, vol. 40, pp. 394-398.
Rothmaier, M. et al., "Design and Performance Cooling Garments Based on Three-Layer Laminates", Med. Biol. Eng. Comput, 2008, vol. 46, pp. 825-832.
Sadineni, S. B. et al., "Passive Building Energy Savings: A Review of Building Envelope Components", Renew. Sustain. Energy Rev., 2011, vol. 15, pp. 3617-3631.
Sanchez-Marin, F., "Novel Approach to Assess the Emissivity of the Human Skin", J. Biomed. Opt., 2009, vol. 14,024006-6.
Sawhney, A. et al., "Special Purpose Fabrics Made with Core-Spun Yarns", Indian J. Fibre Text. Res. 1997, vol. 22, pp. 246-254.
Schael, G., "Determination of Polyolefin Film Properties from Refractive Index Measurements II. Birefringence", J. Appl. Polym. Sci., 1968, vol. 12, pp. 903-914.
Shen, S. et al., "Polyethylene Nanofibres with Very High Thermal Conductivities", Nat. Nanotechnol. 2010, vol. 5, pp. 251-255.
Steinhardt, J. "Intensity Discrimination in the Human Eye: I. The Relation of Detlal/I to Intensity", J. Gen. Physiol., 1936, vol. 20, pp. 185-209.
Steketee, J. "Spectral Emissivity of Skin and Pericardium" Phys. Med. Biol., 1973, vol. 18, pp. 686-694.
Stevens, S., "On the Psychophysical Law", Psychol. Rev. 1957, vol. 64, pp. 153-181.
Stevens, S., "To Honor Fechner and the Repeal of His Law", Science 1961, vol. 133, pp. 80-86.
Tong, J., et al., "Direct and Quantitative Photothermal Absorption Spectroscopy of Individual Particulates", Appl. Phys. Lett. 2013, 103, 261104-5.
Wang, S. et al., "Supervisory and Optimal Control of Building HVAC Systems: A Review", HVACR Res., 2008, vol. 14, pp. 3-32.
Wool, R., "Infrared and Raman Spectroscopy of Stressed Polyethylene", J. Polym. Sci., Part B: Polym. Phys., 1986, vol. 24, pp. 1039-1066.
Xu, W. et al., "Textiles' Properties in the Infrared Irradiation", Text. Res. J, 2007, vol. 77, pp. 513-519.
Yang, J. et al., "Measurement of Airflow around the Human Body with Wide-Cover Type Personal Air-Conditioning with PIV", Indoor Built Environ. , 2009, vol. 18, pp. 301-312.
Yang, Y. et al., "Man-Portable Personal Cooling Garment Based on Vacuum Desiccant Cooling", Appl. Therm. Eng., 2012, vol. 47, pp. 18-24.
Yazdi, M et al., "Personal Cooling Garments: A Review" J. Text. Inst., 2014, vol. 105, pp. 1231-1250.
Yoneda, M., et al., "Analysis of Transient Heat Conduction and Its Applications", J. Text. Mach. Soc. Japan 1983, vol. 29, pp. 73-83.
Zhang, H, et al., "Transmittance of Infrared Radiation Through Fabric in the Range 8-14 mm", Text. Res. J., 2010, vol. 80, pp. 1516-1521.
2011 Buildings Energy Data Book; U.S. Department of Energy; Energy Efficiency and Renewable Energy: Washington, DC, Mar. 2012, 286 pages.
ASTM Standard E96/ E96M, 2013, Standard Test Methods for Water Vapor Transmission of Materials, 2013, 14 pages.
Emig, W. H. Stain Techniques; Science Press: Pittsburgh, 1941, 80 pages.
ISO 11092 Textiles—Physiological Effects—Measurement of Thermal and Water-Vapour Resistance under Steady-State Conditions (sweating Guarded-Hotplate Test), Second Edition, 2014, 22 pages.
Tong, J., et al., "Infrared-Transparent Visible-Opaque Fabrics for Wearable Personal Thermal Management", ACS Photonics, 2015, vol. 2, pp. 769-778.
ASTM Standard F 1868, Standard Test Method for Thermal and Evaporative Resistance of Clothing Materials Using a Sweating Hot Plate, printed May 30, 2017, 9 pages.
Bohren, C. et al., "Absorption and Scattering of Light by Small Particle", Wiley: NY 2004, pp. 57-81.
Boriskina, S. et al., "Accurate Simulation of 2D Optical Microcavities with Uniquely Solvable Boundary Integral Equations and Trigonometric-Galerkin Discretization", J. Opt. Soc. Am. A, 2004, vol. 21, pp. 393-402.
Boriskina, S. et al., "Plasmonic Materials for Energy: From Physics to Applications", Mater. Today, 2013, vol. 16, No. 10, pp. 375-386.
Boriskina, S. et al., "Spectrally and Spatiatly Configurable Superlenses for Optoplasmonic Nanocircuits", Proc. Natl. Acad. Sci. U.S.A., 2011, vol. 108, No. 8, pp. 3147-3151.
Boriskina, S. V. et al., "Sensitive Label-Free Biosensing Using Critical Modes in Aperiodic Photonic Structures", Opt. Express 2008, vol. 16, No. 17, pp. 12511-12522.
Bronstrup, G. et al., "Optical Properties of Individual Silicon Nanowires for Photonic Devices", ACS Nano 2010, vol. 4, No. 12, pp. 7113-7122.
Cao, L., "Engineering Light Absorption in Semiconductor Nanowire Devices", Nat. Nanotechnol. 2009, vol. 8, pp. 643-647.

(56) References Cited

OTHER PUBLICATIONS

Carr, W., et al., "Infrared Absorption Studies of Fabrics", Text. Res. J., 1997, vol. 67, pp. 725-738.
Crangle, A. "Types of Polyolefin Fibres. In Polyolefin Fibres: Industrial and Medical Applications", Ugbolue, S., Ed.; Woodhead Publishing in Textiles: U.K., 2009; pp. 3-34.
Das, B. et al., "Effect of Fibre Diameter and Cross-Sectional Shape on Moisture Transmission through Fabrics", Fibers Polym. 2008, vol. 9, No. 2, pp. 225-231.
Elbel, S. et al., "Development of Microclimate Cooling Systems for Increased Thermal Comfort of Individuals", International Refrigeration and Air Conditioning Conference; West Lafayette, IN, USA, Jul. 2012; Purdue University: West Lafayette, IN, 2012; Paper 1183, 10 pages.
Federspiel, C. "Predicting the Frequency and Cost of Hot and Cold Complaints in Buildings", Cent. Built Environ., vol. 6, No. 4, 2000, pp. 289-305.
Ferwada, J., "Elements of Early Vision for Computer Graphics", IEEE Coniput. Graph. Appl., 2001, vol. 21, pp. 22-33.
Gao, C. et al., "Personal Cooling with Phase Change Materials to Improve Thermal Comfort from a Heat Wave Perspective", Indoor Air, 2012, vol. 22, pp. 523-530.
Ghali, K. et al, "Modeling Moisture Transfer in Fabrics", Exp. Therm Fluid Sci. 1994, vol. 9, pp. 330-336.
Ghasemi, H., et al., "Solar Steam Generation by Heat Localization", Nat. Commun. 2014, vol. 5, 4449, 7 pages.
Gopinath, A. et al., "Photonic-Plasmonic Scattering Resonances in Deterministic Aperiodic Structures", Nano Lett. 2008, vol. 8, No. 8, pp. 2423-2431.
Gopinath, A., et al., "Plasmonic Nanogalaxies: Multiscale Aperiodic Arrays for Surface-Enhanced Raman Sensing" Vano Lett. 2009, vol. 9, No. 11, pp. 3922-3929.
Gurr, E., Encyclopedia of Microscopic Stains; Hill: London, 1960; pp. 72.
Hong, C. et al., "A Study of Comfort Performance in Cotton and Polyester Blended Fabrics I. Vertical Wicking Behavior", Fibers Polym., 2007, vol. 8, No. 2, pp. 218-224.
Hong, Y. et al., "Enhanced Light Focusing in Self-Assembled Optoplasmonic Clusters with Subwavelength Dimensions", Adv. Mat., 2013, vol. 25, pp. 115-119.
Hoyt, T. et al., "Energy Savings from Extended Air Temperature Setpoints and Reductions in Room Air Mixing", In Proceedings of the 13th International Conference on Environmental Ergonomics, Boston, MA, USA, Aug. 2009; Castellani, J.W.; Endrusick, T. L., Eds.; University of Wollongong: Australia, 2009, 7 pages.
Jaksic, D. et al., "Porosity of the Flat Textiles. In Woven Fabric Engineering", Polona Dobnik Dubrovski, Ed.; Sciyo, 2010; pp. 255-272.

* cited by examiner

INFRARED TRANSPARENT VISIBLE OPAQUE FABRICS

CROSS-REFERENCE TO RELATED APPLICATIONS

This application is a continuation of PCT Application No. PCT/US2015/050720, entitled "Infrared Transparent Visible Opaque Fabrics," and filed on Sep. 17, 2015, which claims the benefit under 35 U.S.C. § 119(e) of U.S. Application No. 62/051,348, entitled "Infrared Transparent Visible Opaque Fabrics," and filed on Sep. 17, 2014. Both of these applications are hereby incorporated by reference herein.

BACKGROUND

In recent years, personal cooling technologies have been developed to provide local environmental control to ensure the user remains thermally comfortable when in extreme environmental conditions such as those faced by athletes, the military, or EMS personnel. However, there remains a distinct lack of such technologies for everyday use by the average end user who spends the majority of the time in a sedentary state. This is especially important for indoor environments where incorporation of such technologies can offset energy consumed by HVAC systems for cooling while maintaining sufficient levels of thermal comfort. For instance, recent studies have shown that in the United States alone, residential and commercial buildings consume nearly 41% of total energy use each year with 37% of that energy devoted solely to heating and cooling, according to the 2011 Buildings Energy Data Book from the U.S. Department of Energy—Energy Efficiency & Renewable Energy Department (2011), and an article by Perez-Lombard, L.; Ortiz, J.; Pout, C.: A Review on Buildings Energy Consumption Information, Energy Build, 2008, 40, 394-398. To reduce energy usage, buildings have incorporated more renewable energy sources such as solar power, implemented advanced HVAC systems, utilized higher performing thermal insulation, and phase change materials for thermal storage all of which requires significant financial investment, as described in articles by Sadineni, S. B.; Madala, S.; Boehm, R. F.: Passive Building Energy Savings: A Review of Building Envelope Components in journal Renewable Sustainable Energy Reviews, 2011, 15, 3617-3631; by Wang, S.; Ma, Z. in Supervisory and Optimal Control of Building HVAC Systems: A Review, HVAC&R Research, 2008, 14, 3-32; by Memon, S. A. in Phase Change Materials Integrated in Building Walls: A State of the Art Review in journal Renewable Sustainable Energy Reviews, 2014, 31, 870-906. Instead, personal thermal comfort technologies offer a potentially low cost solution towards mitigating energy use by HVAC systems. Although these technologies can be used in a variety of indoor and outdoor environments, the focus of this work is to provide personal cooling in temperature regulated indoor environments.

At present, several technologies are commercially available which provide varying degrees of personal cooling. However, these technologies are typically tailored as high performance products, such as sportswear, body armor, and personal protection equipment, thus limiting functionality for everyday use. Arguably the most prevalent personal comfort technology used in industry today is moisture wicking where sensible perspiration is drawn away from the skin to the outer surface of the fabric and evaporated to ambient air thus cooling the wearer passively, as described in Hong, C. J.; Kim, J. B. A Study of Comfort Performance in Cotton and Polyester Blended Fabrics. I. Vertical Wicking Behavior. Fibers Polymer. 2007, 8, 218-224; Kaplan, S.; Okur, A. Thermal Comfort Performance of Sports Garments with Objective and Subjective Measurements, Indian Journal of Fibre & Textile Research, 2012, 37, 46-54; and Das, B.; Das, A.; Kothari, V. K.; Fanguiero, R.; de Araújo, M. Effect of Fibre Diameter and Cross-Sectional Shape on Moisture Transmission through Fabrics, Fibers and Polymer. 2008, 9, 225-231. The drawback of this technology is that it is activated only when the wearer is sufficiently perspiring so that moisture accumulates on the skin; thus, moisture wicking is not suitable to provide cooling for sedentary individuals. Other technologies utilize phase change materials in the form of cold packs which can effectively draw heat from the human body due to the high latent heat of melting associated with water and other refrigerants as described in, for example McCullough, E. A.; Eckels, S. Evaluation of Personal Cooling Systems for Soldiers, 13$^{th}$ International Society of Environmental Ergonomics Conference, Boston, Mass., USA, 2009; pp. 200-204; Gao, C.; Kuklane, K.; Wang, F.; Holmér, I. Personal Cooling with Phase Change Materials to Improve Thermal Comfort from a Heat Wave Perspective. Indoor Ai 2012, 22, 523-530; Muir, I. H.; Bishop, P. A.; Ray, P. Effects of a Novel Ice-Cooling Technique on Work in Protective Clothing at 28C, 23C, and 18C WBGTs, American Industrial Hygiene Association Journal, 1999, 60, 96-104; and Rothmaier, M.; Weder, M.; Meyer-Heim, A.; Kesselring, J. Design and Performance Cooling Garments Based on Three-Layer Laminates, Medical & Biological Engineering & Computing, 2008, 46, 825-832. However this technology tends to be bulky in size and requires frequent replacement of the cold packs over time rendering this technology inconvenient and expensive to the end user. And finally, several technologies provide active cooling through use portable air conditioning units or liquid cooling, for example as described in Elbel, S.; Bowers, C. D.; Zhao, H.; Park, S.; Hrnjak, P. S. Development of Microclimate Cooling Systems for Increased Thermal Comfort of Individuals. International Refrigeration and Air Conditioning Conference; 2012; p. 1183; Kayacan, O.; Kurbak, A. Effect of Garment Design on Liquid Cooling Garments, Textile Research Journal, 2010, 80, 1442-1455; Yang, J.-H.; Kato, S.; Seok, H.-T. Measurement of Airflow around the Human Body with Wide-Cover Type Personal Air-Conditioning with PIV, Indoor and Built Environment, 2009, 18, 301-312; Yang, Y.-F.; Stapleton, J.; Diagne, B. T.; Kenny, G. P.; Lan, C. Q. Man-Portable Personal Cooling Garment Based on Vacuum Desiccant Cooling. Applied Thermal Engineering, 2012, 47, 18-24; and Nag, P. K.; Pradhan, C. K.; Nag, A.; Ashetekar, S. P.; Desai, H. Efficacy of a Water-Cooled Garment for Auxiliary Body Cooling in Heat, Ergonomics 1998, 41, 179-187. These systems not only consume power, but also tend to be prohibitively expensive.

SUMMARY

In some embodiments described herein, a radiative cooling fabric comprises woven yarn, wherein the woven yarn substantially comprises fibers having a diameter of approximately 1 μm, and the average separation between fibers in said yarn ranges from about 3 μm to about 10 μm. In another embodiment, the radiative cooling fabric provides an IR transmittance at wavelengths between about 5 μm to about 30 μm ranging from about 30% to about 99%, and a visible reflectance between about 300 nm to about 800 nm ranging from about 40% to about 60%. In another embodiment, the radiative cooling fabric has a porosity of about 0.1 to about 0.2. In another embodiment, the radiative cooling fabric comprises a yarn which has an average diameter ranging from about 30 μm to about 300 μm. In another embodiment, the radiative cooling fabric comprises an average yarn spacing ranging from about 3 μm to about 100 μm. In another embodiment, the fibers in the radiative cooling fabric comprise one or more of polyesters, cellulose, cellulosics, cellulose acetate, polyethylene, polypropylene, or polycaprolactam and other nylons. In another embodiment, the fibers in the radiative cooling fabric consist essentially of one polymer. In another embodiment, the fibers of the radiative cooling fabric comprise 2 or more polymers. In another embodiment, the fibers of the radiative cooling fabric have a core-sheath structure. In another embodiment, the yarn of the radiative cooling fabric comprises fibers of one or more of polyesters, cellulose, cellulosics, cellulose acetate, polyethylene, polypropylene, or polycaprolactam and other nylons. In some other embodiments, the yarn of the radiative cooling fabric comprises fibers having substantially the same composition. In some other embodiments, the yarn of the radiative cooling fabric comprises 2 or more types of fibers. In some other embodiments, the fabric comprises 2 or more types of yarns. In some other embodiments, are provided a garment comprises the radiative cooling fabric.

BRIEF DESCRIPTION OF THE DRAWINGS

The skilled artisan will understand that the drawings primarily are for illustrative purposes and are not intended to limit the scope of the inventive subject matter described herein. The drawings are not necessarily to scale; in some instances, various aspects of the inventive subject matter disclosed herein may be shown exaggerated or enlarged in the drawings to facilitate an understanding of different features. In the drawings, like reference characters generally refer to like features (e.g., functionally similar and/or structurally similar elements). Each document referenced herein is incorporated by reference in its entirety for all purposes.

FIG. 2A shows that a temperature map was computed showing the maximum ambient temperature attainable without compromising thermal comfort as a function of the total reflectance and transmittance of the fabric. It is assumed the air gap is $t_a$=1.05 mm and the convective heat transfer coefficient is h=3 W/m$^2$K. FIG. 2B shows a corresponding temperature map assuming $t_a$=2.36 mm and h=5 W/m$^2$K. The range of h is typical for cooling via natural convection. FIG. 2C shows an additional cooling power curve showing quantitatively the effect of radiative cooling as a function of the total fabric transmittance and reflectance assuming $t_a$=1.05 mm and h=3 W/m$^2$K. FIG. 2D additional cooling power curve assuming $t_a$=2.36 mm and h=5 W/m$^2$K. As shown, by decreasing the reflectance and increasing the transmittance, it is possible to achieve the necessary 23 W of cooling at an ambient temperature of 26.1° C. using only thermal radiation.

FIG. 3A shows SEM images of undyed cotton fabric and FIG. 3B shows SEM images of undyed polyester fabric which show the intrinsic fabric structure. The insets are optical images of the samples characterized. For both samples, the fiber diameter is on average 10 μm and the yarn diameter is greater than 200 μm. The scale bars both correspond to 100 μm. FIG. 3C shows experimentally measured optical properties in the visible wavelength range. FIG. 3D shows experimentally measured FTIR transmittance spectra of undyed cotton fabric (thickness, t=400 μm) and undyed polyester fabric (t=300 μm) showing the opaqueness of common fabrics in the IR.

FIG. 4A shows the FTIR transmittance spectra for a single cotton yarn (diameter, d=200 μm) and a polyester thin-film (thickness, t=12.5 μm). The transmittance spectra are normalized to provide similar scaling due to the order of magnitude difference in sample size. FIG. 4B shows the FTIR transmittance spectra for two candidate materials for the ITVOF. These materials include thin-films of nylon 6 (t=25.4 μm) and UHMWPE (t=102 μm).

FIG. 9A shows a schematic of the machine. FIG. 9B shows a laboratory spinning machine. Two single screw extruders provide polymer flow through a spinneret block.

FIG. 12A is a picture of extrusion system. The system is deployed in a fume hood in order to contain vapors resulting from organic solvents used in dissolution of UHMWPE powder.

FIG. 12B is a picture of drawing system. From this view, only the feed spools, system frame, and heated enclosure are visible.

FIG. 17A shows FTIR transmittance spectrum detailing key vibrational modes supported in dye. FIG. 17B shows UV-Vis absorbance spectra.

DETAILED DESCRIPTION

Figure 1:
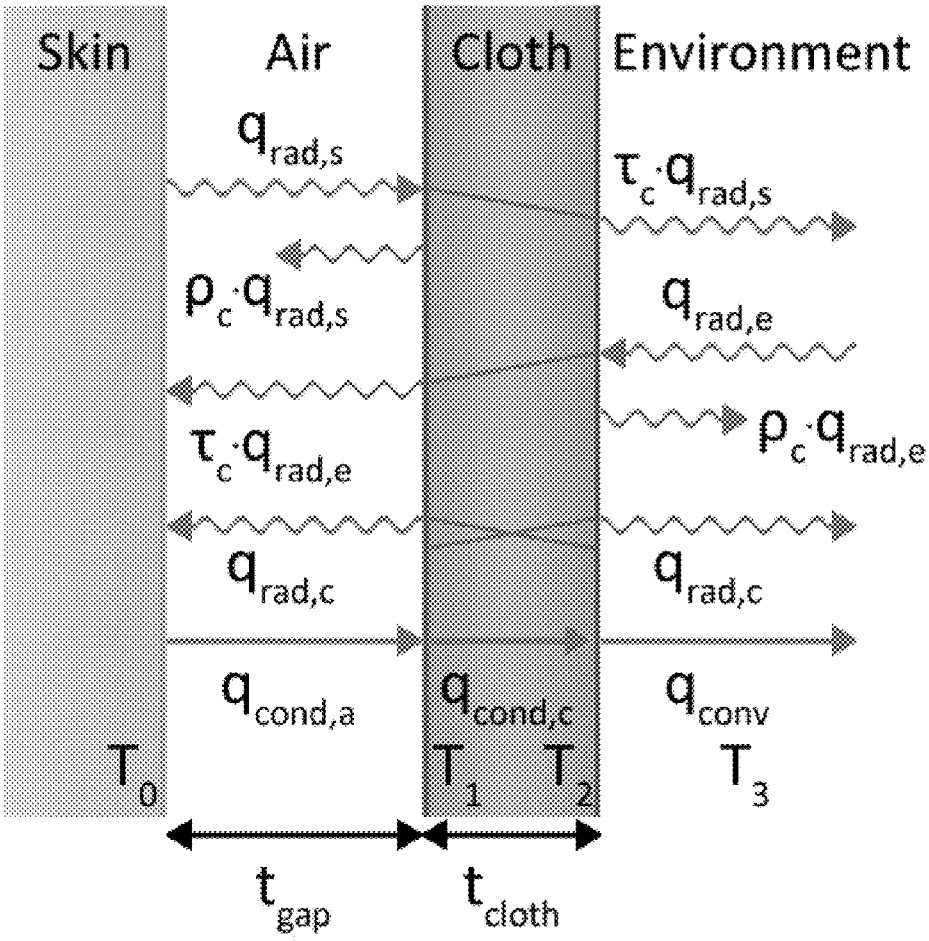
FIG. 1: A heat transfer model was developed to analyze heat dissipation from a clothed human body to the ambient environment. Various heat transfer contributions that lead to dissipation of heat from the human body, such as radiation, heat conduction, and heat convection are included. To model loose fitting clothing, a finite air gap is assumed between the fabric and the skin.

To overcome the limitations of conventional personal cooling technologies, in various embodiments the present disclosure is directed inter alia to radiative cooling fabrics such as infrared-transparent, visible-opaque fabrics (ITVOF), and garments made from such fabrics, which utilize the human body's innate ability to thermally radiate heat as a cooling mechanism during the summer season when environmental temperatures are high. A heat transfer model was developed in order to determine the required IR optical properties of the ITVOF to ensure thermal comfort is maintained for environmental temperatures exceeding the neutral band. From this analysis, it was experimentally observed that existing textiles fail to meet these requirements due to a combination of intrinsic material absorption and structural backscattering in the IR wavelength range. In lieu of these loss mechanisms, a design for an ITVOF has been developed using a combination of optimal material composition and structural photonic engineering. Specifically, synthetic polymers which support few vibrational modes were identified as candidate materials to reduce intrinsic material absorption in the IR wavelength range. To reduce backscattering losses, individual fibers are designed to be comparable in size to visible wavelengths in order to minimize reflection in the IR by virtue of weak Rayleigh scattering while remaining optically opaque in the visible wavelength range due to strong Mie scattering. By additionally reducing the size of the yarn, which is defined as a collection of fibers, less material is used thus decreasing volumetric absorption in the IR wavelength range even further. The ITVOF design is numerically demonstrated to exhibit a high transmittance and a low reflectance in the IR wavelength range while remaining optically opaque in the visible wavelength range. Compared to conventional technologies, an ITVOF can be manufactured into simple form factors while providing a fully passive means to cool the human body regardless of the physical activity level of the user.

Heat Transfer Analysis

In order to quantify the potential cooling power using thermal radiation, the maximum radiative heat transfer achievable between the human body and the surrounding environment can be computed using the Stefan-Boltzmann law. Past studies, such as by Steketee, J. Spectral Emissivity of Skin and Pericardium, in Physics in Medicine and Biology, 1973, 18, 686-694 and by Sanchez-Marin, F. J.; Calixto-Carrera, S.; Villasenor-Mora, C. Novel Approach to Assess the Emissivity of the Human Skin, in Journal of Biomedical Optics, 2009, 14, 024006, have shown that human skin behaves like a blackbody with an emittance near unity in the IR wavelength range. Even if the skin is wet due to perspiration, the emittance is still 0.96 corresponding to water, which suggests human skin is an effective IR emitter for all levels of physical activity, according to the textbook by Incropera, F. P.; Dewitt, D. P.; Bergman, T. L.; Lavine, A. S. Fundamentals of Heat and Mass Transfer; John Wiley & Sons, Inc., 2007. If it is assumed the surface area of an average adult human body is A=1.8 $m^2$, the temperature of human skin is $T_0$=33.9° C. (93° F.), and the ambient temperature is $T_3$=23.9° C. (75° F.), which corresponds to the upper limit of a typical neutral temperature band for human thermal comfort in buildings, the radiative heat transfer coefficient between the skin and the environment is $h_r$=6.25 $W/m^2K$, according to the studies by Hoyt, T.; Lee, K. H.; Zhang, H.; Arens, E.; Webster, T., Energy Savings from Extended Air Temperature Setpoints and Reductions in Room Air Mixing. International Conference on Environmental Ergonomics, 2009; and by Federspiel, C., Predicting the Frequency and Cost of Hot and Cold Complaints in Buildings. Cent. Built Environment, 2000. Under these conditions, the cooling power predicted by the Stefan-Boltzmann law is 112 W, according to Mills, A. F. Heat Transfer; Prentice Hall, 1998. Radiative heat loss from the human body is thus comparable to natural convection and the cooling power actually exceeds the total heat generation rate of $q_{gen}$=105 W assuming a base metabolic rate at rest of 58.2 W/m$^2$, according to ASHRAE Handbook-Fundamentals; ASHRAE, 2005. From this estimation, it can be observed that thermal radiation clearly has the potential to provide significant cooling power.

To fully harness thermal radiation for cooling, clothing fabrics should be transparent to mid- and far-infrared radiation which is the spectral range where the human body primarily emits. Although a total hemispherical transmittance of unity would be ideal, it would be useful to determine the transmittance required for the ITVOF to provide the necessary cooling power for an individual to feel comfortable at different indoor temperatures. This criterion is determined by assuming the cooling power should equal the total heat generation rate of $q_{gen}$=105 W at a skin temperature of $T_0$=33.9° C. (93° F.) and a typical room temperature of $T_3$=23.9° C. (75° F.). Under these conditions, the effective heat transfer coefficient is equal to $h_{ref}$=5.8 W/m$^2$K which is less than the maximum achievable using thermal radiation. If the ambient temperature increases, the additional cooling power, $q_{cool}$, needed is equal to the difference between the total heat generation rate, $q_{gen}$, and the heat loss due to $h_{ref}$, $$q_{cool}=q_{gen}-h_{ref}(T_0-T_3) \quad (1)$$

For this study, the goal is to provide cooling at an elevated ambient temperature of $T_3$=26.1° C. (79° F.), which past studies have shown can lead to nearly 40% energy savings in indoor environments for certain regions of the United States. Using equation (1) at this temperature, the fabric must provide 23 W of additional cooling.

Based on this criterion, a more detailed one-dimensional steady-state heat transfer model is used to determine the total mid- to far-IR transmittance and reflectance required for the ITVOF. This model, as illustrated in FIG. 1, includes a continuous fabric placed at a distance, $t_a$, from the human body to model the effect of a thermally insulating air gap when loose fitting clothing is worn. The fabric is assumed to cover 100% of the human body. The model combines a control volume analysis and an analytical formulation of the temperature profile within the fabric in order to evaluate heat transfer between the human body, the fabric, and the ambient environment. Radiative heat transfer, heat conduction, and convection are all included in the analysis (see Supplementary Information for further details). The thermal conductivity of air is $k_a$=0.027 W/mK and the thermal conductivity of the fabric is assumed to be $k_y$=0.05 W/mK. Assuming a fabric porosity of 0.15 (within a range of about 0.1 to about 0.2), which is typical for common clothing, the effective thermal conductivity of the fabric layer is $k_c$=0.047 W/mK, as calculated by Jakšić, D.; Jakšić, N. Porosity of the Flat Textiles. In Woven Fabric Engineering; SciYo, 2010; pp. 255-272. The thickness of the fabric is conservatively chosen to be $t_c$=0.5 mm and the effect of air circulation through the fabric is neglected. The IR optical properties of the fabric are assumed to be gray and diffuse with the sum of the absorptance, $\alpha_c$, reflectance, $\rho_c$, and transmittance, $\tau_c$, equal to 1.

Figure 2A:
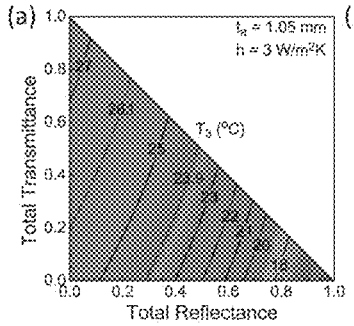
FIGS. 2A-2D illustrate evaluation of ITVOF mid- to far-IR optical requirements to maintain personal thermal comfort at elevated ambient temperatures.
Figure 2B:
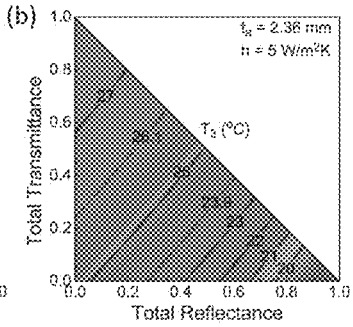

From this model, the effect of the fabric's optical properties on the total cooling power was evaluated by calculating the maximum ambient temperature that can be sustained without compromising personal thermal comfort. FIGS. 2*a* and 2*b* show contour maps of the maximum ambient temperature as a function of the fabric's total reflectance and transmittance for different combinations of the air gap thickness, $t_a$, and the convective heat transfer coefficient, h, which represent a typical range of ambient environmental conditions where natural convection is dominant. In order to properly compare the impact of the fabric's optical properties on cooling for different environmental conditions, $t_a$ and h are coupled such that at an ambient temperature of 23.9° C. (75° F.) and assuming typical optical properties for clothing ($\rho_c$~0.3 and $\tau_c$~0.03), the total cooling power is always equal to the total heat generation rate thus ensuring a consistent baseline neutral temperature band is used, and as described in Lee, T.-W. Thermal and Flow Measurements; CRC Press, 2008.

In both cases, a reflective fabric is more detrimental to cooling performance than an absorptive fabric since a high absorbance implies a high emittance, which would allow clothing to radiate thermal radiation to the environment albeit at a lower temperature. It can also be observed in FIG. 2*a* that in the limit of high absorption, the maximum ambient temperature is higher for the case where the air gap between the skin and fabric is less insulating ($t_a$=1.05 mm) despite the reduction in the convective heat transfer coefficient (h=3 W/m$^2$K). This suggests heat conduction and thermal radiation are comparable in this limit, thus for conventional clothing it is crucial to minimize the thermal resistance to heat conduction. However, as the mid- to far-IR transparency of the fabric increases, radiative heat transfer becomes more dominant compared to heat conduction. As a result, the impact of the insulating air gap on cooling is mitigated, thus a higher maximum ambient temperature can be sustained, when the convective heat transfer coefficient is larger (h=5 W/m$^2$K) even though the air gap is more insulating ($t_a$=2.36 mm) as shown in FIG. 2*b*. These results show that by designing clothing to be transparent to mid- and far-IR radiation, it is possible to provide persistent cooling using thermal radiation even for loose fitting clothing where the trapped air normally acts as a thermally insulating barrier, which impedes heat transfer in conventional personal cooling technologies.

To determine quantitatively the optical properties required for the ITVOF to provide 23 W of additional cooling at an ambient temperature of $T_3$=26.1° C. (79° F.), additional cooling power curves were computed as a function of the fabric's total reflectance and transmittance in FIGS. 2*c* and 2*d*. In the limit of an ideal opaque fabric ($\alpha_c$=1), it can be seen for both cases that it is not possible to reach 23 W of additional cooling. This indicates that unless convective cooling is improved, which is challenging to achieve for everyday use as described earlier, it is impossible to maintain personal thermal comfort using opaque clothing; hence, the clothing must exhibit transparency to mid- and far-IR radiation.

Figure 2C:
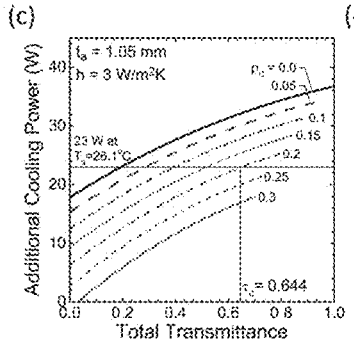
Figure 2D:
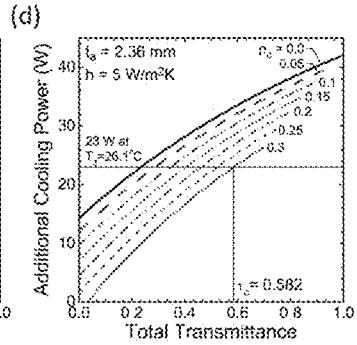

For the case where $t_a$=1.05 mm and h=3 W/m$^2$K in FIG. 2*c*, if the fabric reflectance is larger than 0.2, it is also not possible to reach 23 W of additional cooling. This again shows that a higher fabric reflectance is more detrimental to the cooling performance of the fabric than absorption. Thus, when increasing the transmittance of the fabric, it is crucial that the reflectance is simultaneously reduced in order to maximize radiative cooling. Based on these results, the ITVOF must exhibit a maximum reflectance of 0.2 and a minimum transmittance of 0.644 in order to meet the personal thermal comfort criterion. For the case where $t_a$=2.36 mm and h=5 W/m$^2$K in FIG. 2*d*, the optical properties of the ITVOF become less stringent with a maximum reflectance of 0.3 and a minimum transmittance of 0.582. It should be emphasized that the reflectance and transmittance of the ITVOF are intrinsically coupled, thus a decrease in reflectance will lead to a corresponding decrease in the transmittance required to maintain thermal comfort as shown in FIGS. 2*c* and 2*d*.

Experimental Characterization of Common Clothing

Figure 3A:
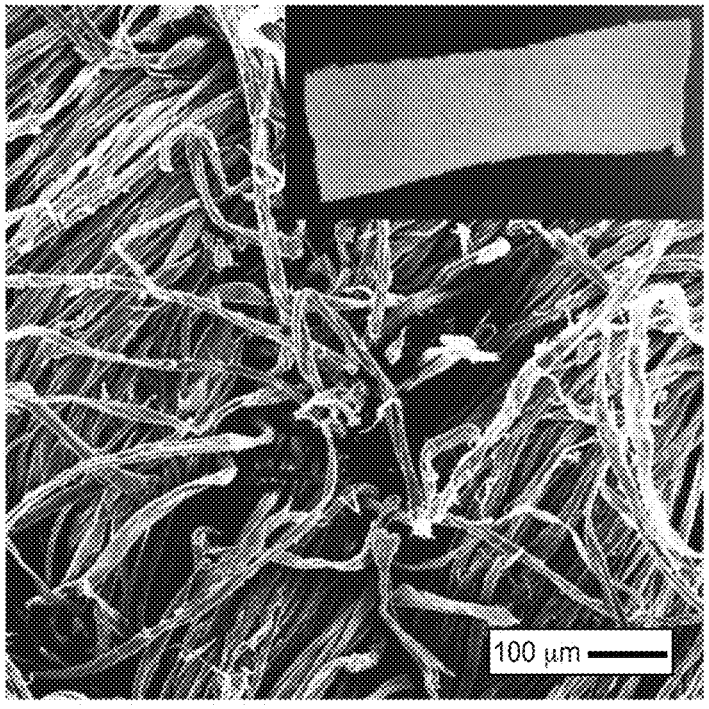
FIGS. 3A-3D: Optical properties of conventional clothing.
Figure 3B:
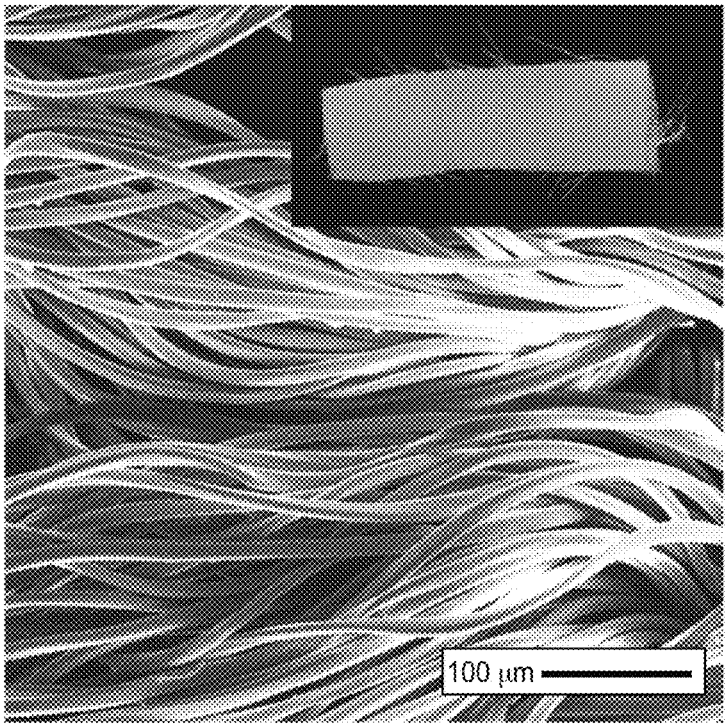

In order to design the ITVOF, a baseline reference was first established by characterizing the optical properties of common clothing. Specifically, the optical properties of undyed cotton and polyester fabrics, which comprise nearly 78% of all textile fiber production, were measured in both the visible and IR wavelength ranges, as in the article by the Oerlikon Leybold Group, The Fiber Year 2006/07—A World Survey on Textile and Nonwovens Industry, 2007. FIGS. 3*a* and 3*b* show SEM images of the cotton and polyester fabrics, respectively. The fabrics consist of fibers with a diameter of ~10 μm sewn into yarns that are 200 μm to 300 μm in size. Depending on the weave, the yarn can intertwine and overlap differently; however, the thickness of the fabric generally varies from one yarn to two overlapping yarns.

Figure 3C:
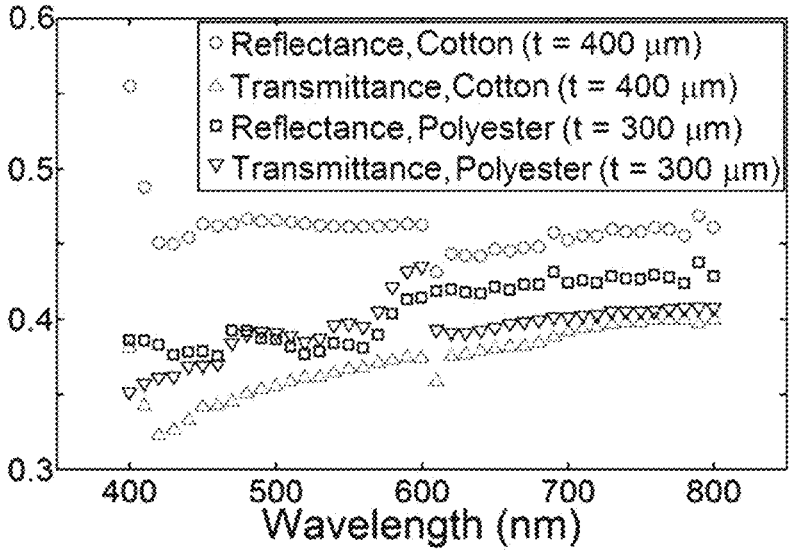

The visible wavelength optical properties of both fabric samples were measured using a UV/visible spectrometer. To account for the diffuse scattering of light from the samples, an integrating sphere was used to measure the hemispherical reflectance and transmittance of the fabric in the wavelength range of 400 nm to 800 nm. The results are shown in FIG. 3*c*. As expected, the undyed fabric samples exhibit no distinct optical features in the reflectance and transmittance spectra. Both samples show similar optical properties with a reflectance ranging from 0.4 to 0.5 and a transmittance ranging from 0.3 to 0.4. The high transmittance is primarily due to the intrinsic properties of cotton and polyester which are weakly absorbing in the visible wavelength range, according to the studies by Laskarakis, A.; Logothetidis, S. Study of the Electronic and Vibrational Properties of Poly (ethylene Terephthalate) and Poly(ethylene Naphthalate) Films, in the Journal of Applied Physics, 2007, 101, 05350; and by Palik, E. D. Handbook of Optical Constants of Solids; Academic Press, 1997.

Although these fabric samples exhibit a high transmittance, their apparent opaqueness is due to a combination of the contrast sensitivity of the human eye and the diffuse scattering of light. The human eye is a remarkably sensitive optical sensor that can respond to a large range of light intensities, as described in Ferwada, J. Elements of Early Vision for Computer Graphics. IEEE Xplore: Computer Graphics and Applications, 2001, 21, 21-23; and Wandell, B. A. Foundations of Vision; Sinauer Associates, 1995. However, past studies, such as Stevens, S. S. On the Psychophysical Law, Psychological Review, 1957, 64, 153-181; Fechner, G. T. Elemente Der Psychophysik; Breitkopf and Hartel: Leipzig, 1860; Stevens, S. S. To Honor Fechner and the Repeal of His Law. Science 1961, 133, 80-86; and Steinhardt, J. Intensity Discrimination in the Human Eye: I. The Relation of DeltaI/I to Intensity, in the Journal of General Physiology, 1936, 20, 185-209, have shown that the human eye can only perceive variations in light intensity when the change in intensity relative to the background is sufficiently large. This implies that for clothing to appear opaque, the fraction of light reflected by the skin and observed by the human eye must be sufficiently smaller than the fraction of light reflected by the fabric into the same direction. For these fabric samples, light will reflect and transmit diffusively. In addition, skin is also a diffuse surface with a reflectance that is as high as 0.6 at longer wavelengths, as described by Norvang, L. T.; Milner, T. E.; Nelson, J. S.; Berns, M. W.; Svaasand, L. O. Skin Pigmentation Characterized by Visible Reflectance Measurements. Lasers in Medical Science, 1997, 12, 99-112. Since the observation of skin requires light to be reflected from the skin and transmitted through the fabric twice, more light will be scattered into directions beyond what is observable by the human eye compared to light that is only reflected by the fabric thus ensuring the opaque appearance of the fabric. It is for these reasons that common clothing appears opaque to the human eye despite an inherently high transmittance. From these results, the criteria for opaqueness of the ITVOF design are assessed by comparing the hemispherical reflectance and transmittance to measured data shown in FIG. 3*c*.

Figure 3D:
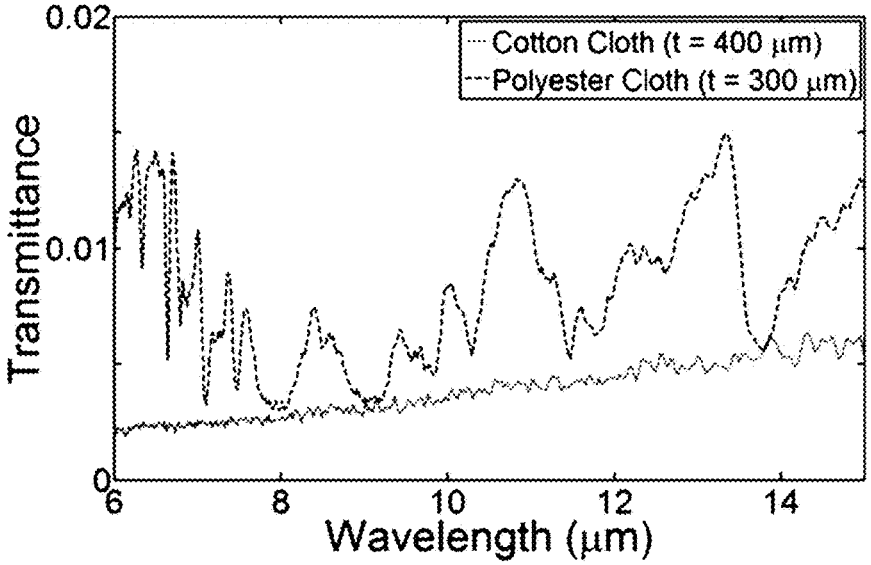

The IR transmittance spectra of the fabric samples, shown in FIG. 3*d*, were measured using a Fourier transform infrared (FTIR) spectrometer with a microscope objective accessory. Both the cotton and polyester samples exhibit a low transmittance of 1% across the entire IR wavelength range in agreement with previous studies by Zhang, H.; Hu, T.; Zhang, J. Transmittance of Infrared Radiation Through Fabric in the Range 8-14 mm, Textile Research Journal, 2010, 80, 1516-1521; Carr, W. W.; Sarma, D. S.; Johnson, M. R.; Do, B. T.; Williamson, V. A.; Perkins, W. A. Infrared Absorption Studies of Fabrics, Textile Research Journal, 1997, 67, 725-738; and Xu, W.; Shyr, T.; Yao, M. Textiles' Properties in the Infrared Irradiation, Textile Research Journal, 2007, 77, 513-519. Therefore, both samples are opaque in the IR and thus cannot provide the necessary cooling to the wearer at higher ambient temperatures according to the heat transfer model.

Figure 4A:
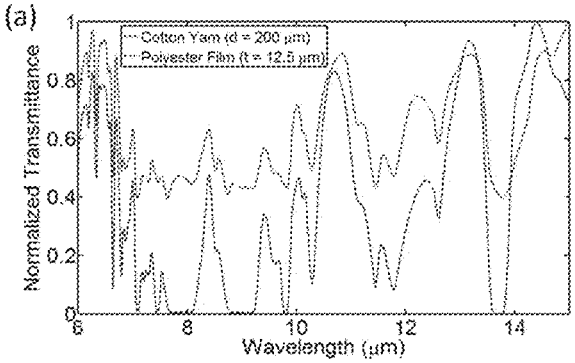
FIGS. 4A and 4B show intrinsic absorptive properties of various synthetic polymers.

The reasons for the low transmittances are two-fold. First, cotton and polyester are highly absorbing in the IR wavelength range. FIG. 4*a* shows the FTIR transmittance spectra of a single strand of cotton yarn and a polyester thin film. Several absorption peaks can be observed which originate from the many vibrational modes supported in the complex molecular structure of these materials. Since fabrics are typically several hundreds of microns thick, which is much larger than the penetration depth, incident IR radiation is completely absorbed at these wavelengths. Second, the fibers in clothing are comparable in size to IR wavelengths, as shown in FIGS. 3*a* and 3*b*, which enable the fibers to support optical resonances that can strongly scatter incident light. In this Mie regime, it is well known that particles can exhibit large scattering cross sections due to these resonances, as shown by Bohren, C. F.; Huffman, D. R. Absorption and Scattering of Light by Small Particles; WILEY-VCH Verlag GmbH & Co. KGaA, 2007; Bohren, C. F.; Huffman, D. R. Absorption and Scattering by an Arbitrary Particle. Absorption Scattered Light by Small Particles, 1998, 57-81; Bronstrup, G.; Jahr, N.; Leiterer, C.; Csaki, A.; Fritzsche, W.; Christiansen, S. Optical Properties of Individual Silicon Nanowires for Photonic Devices. ACS Nano 2010, 4, 7113-7122; Cao, L.; White, J. S.; Park, J.-S.; Schuller, J. A.; Clemens, B. M.; Brongersma, M. L. Engineering Light Absorption in Semiconductor Nanowire Devices, Nature Nanotechnology 2009, 8, 643-647; Tong, J. K.; Hsu, W.-C.; Han, S.-E.; Burg, B. R.; Zheng, R.; Shen, S.; Chen, G. Direct and Quantitative Photothermal Absorption Spectroscopy of Individual Particulates, Applied Physics Letters 2013, 103; and Boriskina, S. V.; Sewell, P.; Benson, T. M.; Nosich, A. I. Accurate Simulation of 2D Optical Microcavities with Uniquely Solvable Boundary Integral Equations and Trigonometric-Galerkin Discretization, Journal of Optical Society of America A 2004, 21, 393-402. For an array of many fibers, the collective scattering by the fibers can result in a high reflectance. Therefore, the creation of an ITVOF must minimize these two contributions in order to maximize transparency to mid- and far-IR radiation.

Design and Simulation of an ITVOF

Based on the heat transfer modeling and the experimental results, the design strategy for an ITVOF is to use alternative synthetic polymers which are intrinsically less absorptive in the IR wavelength range and to structure the fibers to minimize the overall reflectance of the fabric in order to maximize radiative cooling. In general, synthetic polymers with simple chemical structures are ideal since fewer vibrational modes are supported thus resulting in less absorption. Additionally, these polymers must also be compatible with extrusion and drawing processes to ensure manufacturability for large scale production. Based on these criteria, polyethylene and polycaprolactam (nylon 6), a type of nylon, were identified as potential candidate materials. Other polyolefins such as polypropylenes, polyethylene/polypropylene copolymers, and other nylons such as nylon 6,6 (i.e., a copolymer of hexamethylene diamine and adipic acid), nylon 6/66 (i.e., a copolymer of caprolactam, hexamethylene diamine, and adipic acid), nylon 66/610 (i.e., a copolymer of caprolactam, hexamethylene diamine, and sebacic acid), nylon 11 (i.e., a polymer of 11-aminoundecanoic acid), nylon 12 (i.e., a polymer of ω-aminolauric acid), nylon 4,6, nylon 4,10, etc. can be used. In addition, polyesters such as PET, cellulose, and cellulose derivatives such as cellulose acetate, reconstituted cellulose, and other cellulosic polymers can also be used. It should be emphasized however that given the full gamut of synthetic polymers available, other synthetic polymers may also be suitable for an ITVOF.

Polyethylene is one of the simplest synthetic polymers available and the most widely used in industry today. The chemical structure of polyethylene consists of a repeating ethylene monomer with a total length that varies depending on the molecular weight. Because the chemical structure consists entirely of carbon-carbon and carbon-hydrogen bonds, few vibrational modes are supported. This is evidenced in FIG. 4*b* which shows measured FTIR transmittance spectra for an ultra-high molecular weight polyethylene (UHMWPE) thin-film (McMaster 85655K11). Absorption peaks can be observed at 6.8 μm corresponding to $CH_2$ bending modes, 7.3 μm and 7.6 μm to $CH_2$ wagging modes, and 13.7 μm and 13.9 μm to $CH_2$ rocking modes, as shown for example in Krimm, S.; Liang, C. Y.; Sutherland, G. B. B. M. Infrared Spectra of High Polymers. II. Polyethylene, in the Journal of Chemical Physics, 1956, 25, 549. At longer wavelengths, additional rocking modes do exist, but are typically very weak. For textile applications, woven polyethylene fabrics are often used as geotextiles, tarpaulins, and tapes, according to the article by Crangle, A. Types of Polyolefin Fibres. In Polyolefin Fibres: Industrial and Medical Applications; Ugbolue, S., Ed.; Woodhead Publishing in Textiles, 2009; pp. 3-34. To assess the suitability of polyethylene for clothing applications, further studies are needed to evaluate mechanical comfort and durability.

Figure 4B:
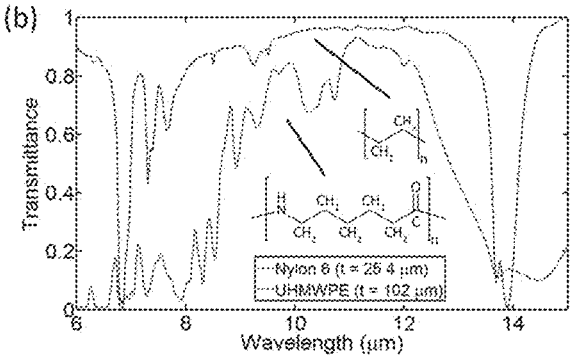

Nylon (McMaster 8539K191) exhibits a similar structure to polyethylene with the key difference being the inclusion of an amide chemical group. As shown in FIG. 4*b*, this results in additional vibrational modes from 6 μm to 8 μm and 13 μm to 14 μm corresponding to the various vibrational modes from the amide group, according to the textbook Infrared and Raman Spectroscopy: Methods and Applications; Schrader, B., Ed.; VCH, 2007. Although nylon is absorptive over a larger wavelength range compared to polyethylene, the advantage of nylon is that it is currently used in many textiles.

Compared to cotton and polyester, FIG. 4*b* shows that polyethylene and nylon exhibit fewer vibrational modes particularly in the mid-IR wavelength range near 10 μm where the human body thermally radiates the most energy. This indicates that polyethylene and nylon are intrinsically less absorptive and are therefore suitable for the creation of an ITVOF.

In order to further improve the IR transparency of an ITVOF constructed from these materials, structural photonic engineering can be introduced for both the fiber and yarn. Specifically, absorption by weaker vibrational modes can be minimized by reducing the material volume. This can be accomplished by simply decreasing the yarn diameter. To minimize backscattering of IR radiation, the fibers can also be reduced in size such that the diameter is small compared to IR wavelengths. In this manner, incident IR radiation will experience Rayleigh scattering where the scattering cross section of infinitely long cylinders in this regime decreases rapidly as a function of the diameter raised to the $4^{th}$ power. By reducing the scattering cross section, back scattering of IR radiation will significantly decrease resulting in an overall lower IR reflectance.

Conversely, for the visible wavelength range the ITVOF must instead have a low transmittance to ensure ITVOF-based clothing is opaque to the human eye. Since polyethylene and nylon are not strongly absorptive in the visible wavelength range, reflection must be maximized. This can be achieved by using fibers that are comparable in size to visible wavelengths so that incident light experiences Mie scattering. In exactly the same manner that conventional clothing is opaque to IR radiation, fibers in this regime can support optical resonances that significantly increase the scattering cross section of each fiber thus increasing the overall backscattering of incident light. Since the fabric is composed of an array of these fibers, not only will the total reflectance increase, but light scattering with the fabric will become more diffuse. In conjunction with the contrast sensitivity of the human eye, this design approach can ensure the ITVOF is opaque to the human eye. Thus, the beauty of this structuring approach is that with an optimally chosen fiber diameter, two different regimes of light scattering are utilized in different spectral ranges in order to create a fabric which is simultaneously opaque in the visible wavelength range and transparent in the IR wavelength range.

In regards to the coloration of the ITVOF, polyethylene and nylon exhibit dispersionless optical properties in the visible wavelength range and with sufficient backscattering appear white in color. Despite the chemical inertness of polyethylene, it is possible to provide coloration through the introduction of pigments during fiber formation when polyethylene is in a molten state, according to Charvat, R. A. Coloring of Plastics: Fundamentals; John Wiley & Sons, Ltd., 2005. On the other hand, nylon fibers can be colored easily using conventional dyes, for example as described in Colorants and Auxiliaries: Organic Chemistry and Application Properties; Shore, J., Ed.; Society of Dyers and Colourists, 2002. Depending on the pigment or dye, additional vibrational modes may be introduced in the IR wavelength range reducing the overall transparency.

Figure 5:
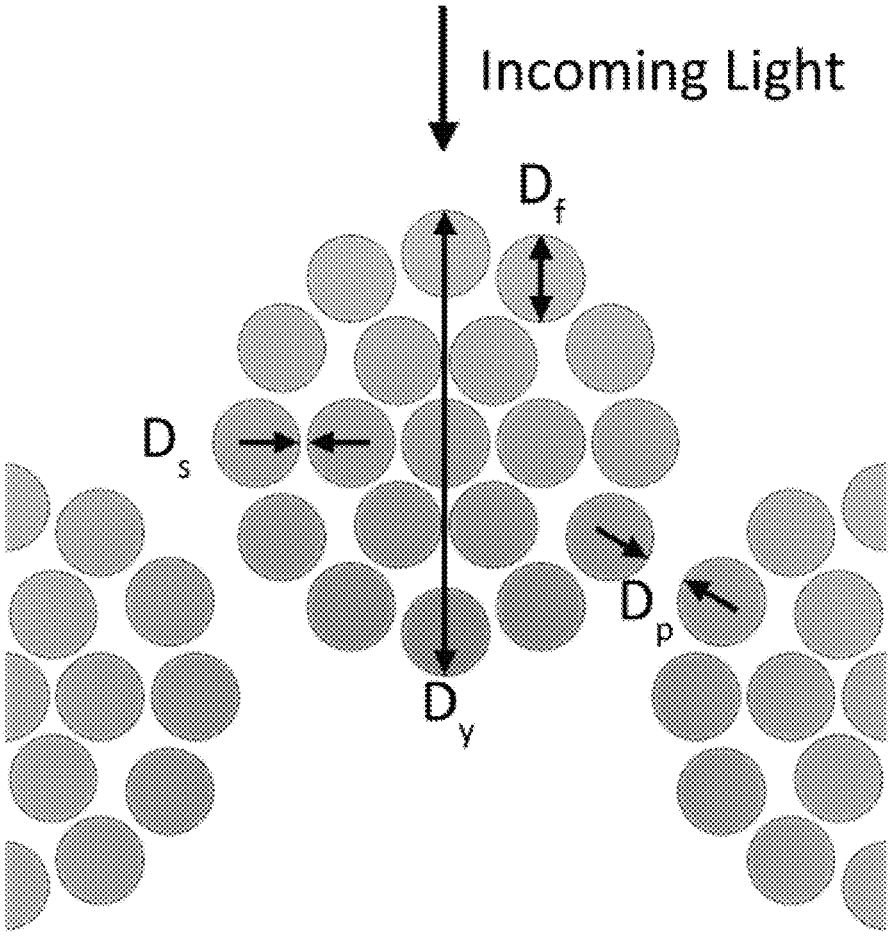
FIG. 5: A schematic of the numerical simulation model used to predict the optical properties of the ITVOF design. The parameters include: $D_f$—the fiber diameter, $D_y$—the yarn diameter, $D_s$—the fiber separation distance, and $D_p$—the yarn separation distance. For all simulations, the yarns were staggered 30° relative to the horizontal plane. In addition, incident light was assumed to be at normal incidence and the optical properties for unpolarized light were calculated by average light polarized parallel and perpendicular to the fiber axis.

To theoretically demonstrate the present strategy to create an ITVOF, numerical finite-element electromagnetic simulations were performed on a polyethylene fabric structure illustrated in FIG. 5. In these simulations, circular arrays of parallel fibers are arranged into collective bundles in order to represent the formation of yarn. The yarn is then positioned in a periodic staggered configuration oriented 30° relative to the horizontal plane to mimic the cross section of a woven fabric. For all simulations, it is assumed the fiber separation distance, $D_s$, is 1 μm and the yarn separation distance, $D_p$, is 5 μm, which is consistent with the fabric structures observed in FIGS. 3*a* and 3*b*. Simulations in the IR wavelength range were conducted from 5.5 μm to 24 μm. Wavelengths shorter than 5.5 μm contribute only 2.7% to total blackbody thermal radiation and are thus considered negligible. Wavelengths longer than 24 μm contribute 17.2% to total blackbody thermal radiation; however, longer wavelengths are expected to yield an even higher transparency since polyethylene does not support vibrational modes beyond 24 μm. As a conservative estimate, the optical properties of the ITVOF design are spectrally integrated and normalized within only the 5.5 μm to 24 μm wavelength range, which will underestimate the transmittance and overestimate the reflectance and absorbance. Furthermore, the spectral integration is weighted by the Planck's distribution assuming a skin temperature of 33.9° C. (93° F.).

Floquet periodic boundary conditions are used on the right and left boundaries to simulate an infinitely wide structure. Perfectly matched layers are used on the top and bottom boundaries to simulate an infinite free space. Simulations were conducted for incident light polarized parallel and perpendicular to the fiber axis at normal incidence. The optical properties for unpolarized light were determined by taking an average of the results for both polarizations. The optical constants of bulk polyethylene were taken from the literature. Although the manufacture of polymer fibers and the subsequent stress imposed when woven into fabrics can introduce anisotropy in the dielectric permittivity, it has been experimentally shown that the optical properties of drawn UHMWPE exhibit minimal change when subjected to a high draw ratio and high stresses, in the past studies by Schael, G. w. Determination of Polyolefin Film Properties from Refractive Index Measurements. II. Birefringence, in the Journal of Applied Polymer Science, 1968, 12, 903-914; and by Wool, R. P.; Bretzlaff, R. S. Infrared and Raman Spectroscopy of Stressed Polyethylene, in the Journal of Polymer Science Part B: Polymer Physics, 1986, 24, 1039-1066. Therefore, anisotropic effects were neglected in this study.

Figure 6:
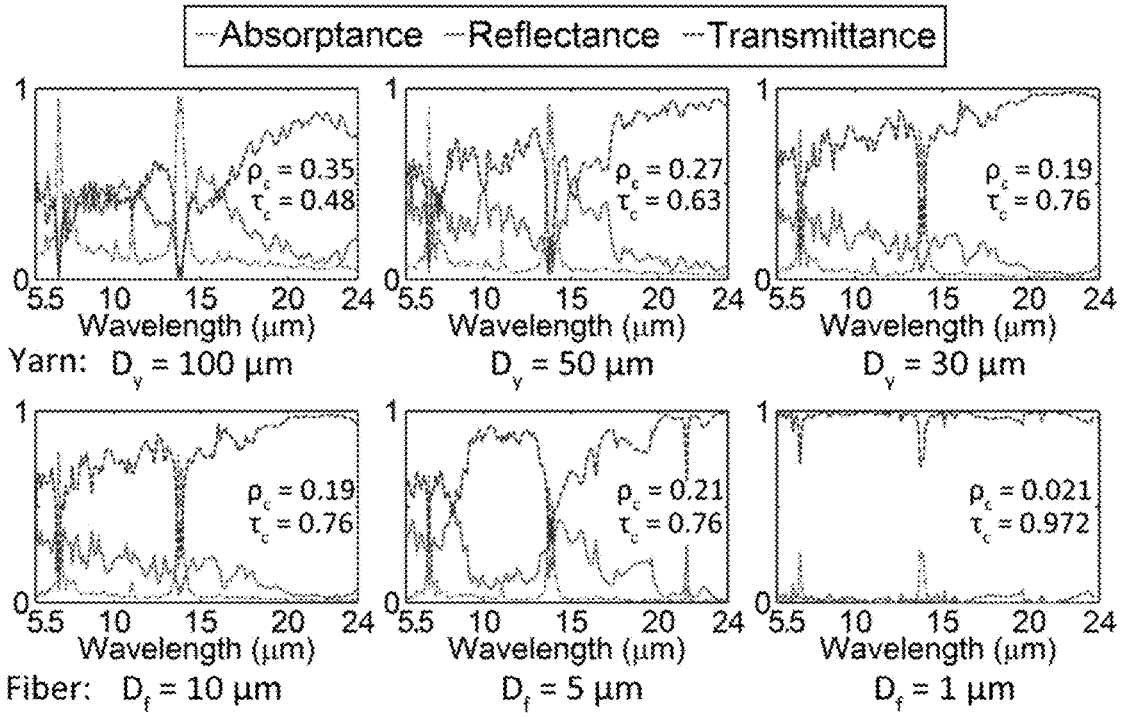
FIG. 6: Numerical simulation results for the IR optical properties of a polyethylene-based ITVOF illustrating the effect of reducing the fiber and yarn size. Upper row: The yarn diameter is varied ($D_y$=30 μm, 50 μm, and 100 μm) assuming a fixed fiber diameter of $D_f$=10 μm. Lower row: The fiber diameter is varied ($D_f$=1 μm, 5 μm, and 10 μm) assuming a fixed yarn diameter of $D_y$=30 μm. For all simulations, the fiber separation distance is $D_s$=1 μm and the yarn separation distance is $D_p$=5 μm. The spectrally integrated transmittance ($\tau_c$) and reflectance ($\rho_c$) is shown in each plot weighted by the Planck's distribution assuming a body temperature of 33.9° C. (93° F.). For $D_f$=10 μm, the material volume per unit depth for a single yarn is 4870 μm$^2$ for $D_y$=100 μm, 1492 μm$^2$ for $D_y$=50 μm, and 550 μm$^2$ for $D_y$=30 μm. For $D_y$=30 μm, the material volume is 373 μm$^2$ for $D_f$=5 μm and 136 μm$^2$ for $D_f$=1 μm. The optical properties of the ITVOF are calculated for the wavelength range from 5.5 to 24 μm, which will provide a conservative estimate of the total transmittance and the reflectance.

To assess the impact of reducing the size of the fiber ($D_f$) and the yarn ($D_y$), the IR optical properties were computed by varying the yarn diameter ($D_y$=30 μm, 50 μm, and 100 μm) assuming a fixed fiber diameter of $D_f$=10 μm and by varying the fiber diameter ($D_f$=1 μm, 5 μm, and 10 μm) assuming a fixed yarn diameter of $D_y$=30 μm. The results are shown in FIG. 6 along with the total spectrally integrated IR transmittance ($\tau_c$) and reflectance ($\rho_c$) weighted by the Planck's distribution assuming a skin temperature of 33.9° C. (93° F.). Based on these results, a reduction in the yarn diameter does yield a higher spectral transmittance in the IR wavelength range as evidenced by the increase in the total hemispherical IR transmittance from 0.48 for $D_y$=100 μm to 0.76 for $D_y$=30 μm. Simultaneously, the total hemispherical IR reflectance also decreases from 0.35 to 0.19. This can be explained by a reduction in the total material volume, which is defined in this study for a single yarn on a per unit depth basis with units of $\mu m^2$ corresponding to the cross section of the yarn. As the yarn diameter decreases from $D_y$=100 μm to $D_y$=30 μm, the material volume decreases from 4870 $\mu m^2$ to 550 $\mu m^2$, which results in less absorption. Additionally, a reduction in the yarn diameter will also decrease the number of fibers that can scatter incident IR radiation, which leads to less reflection. These results suggest that by decreasing only the yarn diameter to $D_y$=30 μm, it is possible to create an ITVOF that already exceeds the minimum transmittance of 0.644 and maximum reflectance of 0.2 required to maintain thermal comfort at an ambient temperature of 26.1° C. (79° F.) in FIG. 2*c*.

However, the spectral optical properties in FIG. 6 indicate there is still room to further improve the transparency of the ITVOF as absorption and reflection are still substantial particularly at shorter wavelengths. In this wavelength range, the size of the fiber ($D_f$=10 μm) is comparable to the wavelength and is thus in the Mie regime where the fiber can support cavity resonances that can couple to and scatter incident IR radiation. Since the mode density of these resonances is higher at shorter wavelengths, the overall reflectance of the fabric structure will be higher as well. By reducing the size of the fiber, the number of supported cavity resonances will decrease resulting in a lower reflectance. The total material volume will also be reduced further from 550 $\mu m^2$ for $D_f$=10 μm to 136 $\mu m^2$ for $D_f$=1 μm thus decreasing the absorbance even further.

When the fiber diameter is reduced to 5 μm, the absorbance exhibits a marginal decrease. On the other hand, the reflectance actually increases compared to the case where $D_f$=10 μm. This indicates that the fiber is still sufficiently large enough to support cavity resonant modes. Although there are fewer modes supported, as shown by the variation in reflectance, these modes become leakier for smaller size fibers thus resulting in a larger scattering cross section and a higher reflectance. As a result, there is little enhancement to the overall IR transmittance. Once the fiber diameter decreases to 1 μm, the reflectance dramatically decreases, which suggests the fiber is sufficiently small such that incident mid- to far-IR radiation will primarily experience Rayleigh scattering. In this Rayleigh regime, the fibers are too small to support cavity mode resonances thus reducing the reflection of IR radiation. Furthermore, the reduction in fiber size further reduces the total material volume again decreasing the absorbance. As a result, the total mid- to far-IR transmittance further increases from 0.76 for $D_f$=10 μm to 0.972 for $D_f$=1 μm, making the structure even more transparent to thermal radiation emitted by the human body. Simultaneously, the total mid- to far-IR reflectance decreases substantially from 0.19 to 0.021. By reducing the fiber diameter, the resulting improvements to the optical properties enable this ITVOF design to clearly surpass the requirements needed to provide 23 W of additional cooling at an ambient temperature of 26.1° C. (79° F.) based on FIGS. 2*c* and 2*d*. It should again be noted that the calculated optical properties of the ITVOF only considered wavelengths from 5.5 μm to 24 μm. Since polyethylene is transparent at longer wavelengths, these results likely underestimate the total hemispherical transmittance and overestimate the total hemispherical reflectance and absorbance for mid- and far-IR radiation.

Figure 7:
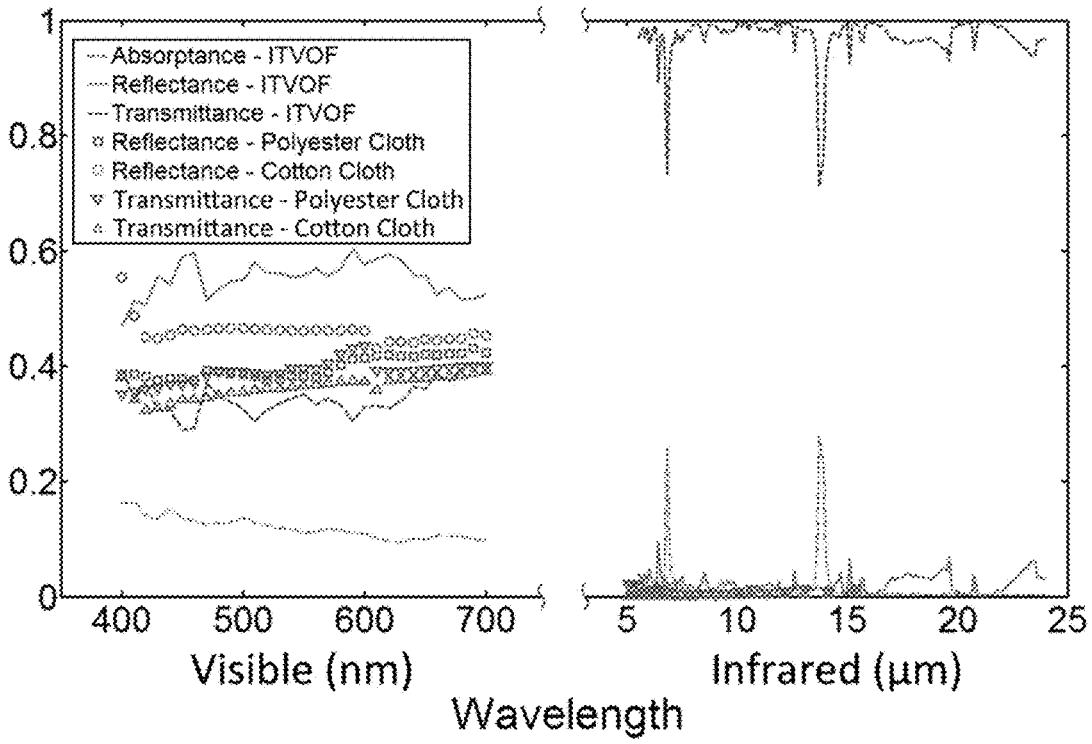
FIG. 7: Theoretical results for the visible and IR wavelength range highlighting the contrast in optical properties needed for an ITVOF. These results correspond to the case of $D_f$=1 μm, $D_y$=30 μm, $D_s$=1 μm, and $D_p$=5 μm. For comparison, the experimentally measured reflectances and transmittances of cotton and polyester fabrics are also shown.

To assess the visible opaqueness, additional simulations were performed for the polyethylene-based ITVOF design assuming a constant refractive index of n=1.5 and an extinction coefficient of $k=5\cdot10^{-4}$ based on literature values for the visible wavelength range from 400 nm to 700 nm. These simulations were performed for the optimal design where $D_f$=1 μm, $D_y$=30 μm, $D_s$=1 μm, and $D_p$=5 μm. The results are shown in FIG. 7 along with the experimentally measured optical properties of undyed cotton and polyester fabric for comparison. The polyethylene-based ITVOF design exhibits a total hemispherical reflectance higher than 0.5 and a hemispherical transmittance less than 0.4 across the entire visible wavelength range, which is comparable to the optical properties of the experimentally characterized cotton and polyester fabric samples. The oscillatory behavior of the total hemispherical absorbance is indicative of whispering gallery and Fabry-Perot resonances supported in each fiber which confirms that light interaction is indeed in the Mie regime. As a result, these optical resonances provide strong backscattering to help ensure the fabric is opaque.

It can also be observed in FIG. 7 that the reflectance and transmittance do not follow the same trend as the absorbance. This can be attributed to the optical coupling of neighboring fibers in the fabric which collectively introduce additional optical resonances in the system due to the periodic nature of the assumed fabric structure. For a more realistic fabric structure where fiber and yarn spacing are nonuniform, long range optical coupling will be minimized resulting in a fabric which more diffusively scatters light. Due to the similarity to the experimentally characterized fabric samples, these results suggest the ITVOF design is optically opaque to the human eye. Furthermore, FIG. 7 clearly shows the contrast between the visible and IR properties of the ITVOF design which indicates that by optimally sizing the fiber, two vastly different regimes of light scattering can be simultaneously used.

Based on these results, it may appear that the creation of an ITVOF requires substantial reduction in material volume since the highest IR transmittance of 0.972 was predicted for the smallest yarn diameter ($D_y$=30 μm) and fiber diameter ($D_f$=1 μm). Although decreasing both of these parameters will certainly improve the overall transmittance in the IR wavelength range, additional simulations for various fiber diameters ($D_f$=1 μm, 5 μm, and 10 μm) assuming a larger yarn diameter of $D_y$=50 μm show a similar trend in the enhancement of transmittance. For a fiber diameter of $D_f$=1 μm, the total hemispherical IR transmittance and reflectance was 0.969 and 0.019, respectively, which is similar to the case where $D_y$=30 μm despite a material volume that is three times larger at 445 $\mu m^2$. This result shows that reducing the fiber diameter is far more effective to improving transmittance compared to reducing the yarn diameter. Therefore, it may be suitable to create an ITVOF that is comparable in size to conventional fabrics so long as the fiber diameter is sufficiently small.

Suitable fiber diameters for an ITVOF should therefore be approximately 1 μm, ranging from about 0.5 μm to about 3.0 μm, including about 0.5 μm, about 0.6 μm, about 0.7 μm, about 0.8 μm, about 0.9 μm, about 1 μm, about 1.1 μm, about 1.2 μm, about 1.3 μm, about 1.4 μm, about 1.5 μm, about 1.6 μm, about 1.7 μm, about 1.8 μm, about 1.9 μm, about 2.0 μm, about 2.1 μm, about 2.2 μm, about 2.3 μm, about 2.4 μm, about 2.5 μm, about 2.6 μm, about 2.7 μm, about 2.8 μm, about 2.9 μm, about 3.0 μm, inclusive of all ranges and subranges therebetween.

In various embodiments, the average spacing or separation between fibers in the ITVOF fabric or yarn should be approximately 5 μm, ranging from about 3 μm to about 10 μm, including about 3 μm, about 4 μm, about 5 μm, about 6 μm, about 7 μm, about 8 μm, about 9 μm, or about 10 μm, inclusive of all ranges and subranges therebetween.

In various embodiments, the yarn of the ITVOF fabric should have an average diameter ranging from about 30 μm to about 300 μm, including about 30 μm, about 35 μm, about 40 μm, about 45 μm, about 50 μm, about 55 μm, about 60 μm, about 65 μm, about 70 μm, about 75 μm, about 80 μm, about 85 μm, about 90 μm, about 95 μm, about 100 μm, about 105 μm, about 110 μm, about 115 μm, about 120 μm, about 125 μm, about 130 μm, about 135 μm, about 140 μm, about 145 μm, about 150 μm, about 155 μm, about 160 μm, about 165 μm, about 170 μm, about 175 μm, about 180 μm, about 185 μm, about 190 μm, about 195 μm, about 200 μm, about 205 μm, about 210 μm, about 215 μm, about 220 μm, about 225 μm, about 230 μm, about 235 μm, about 240 μm, about 245 μm, about 250 μm, about 255 μm, about 260 μm, about 265 μm, about 270 μm, about 275 μm, about 280 μm, about 285 μm, about 290 μm, about 295 μm, or about 300 μm, inclusive of all ranges and subranges therebetween.

In various embodiments, the ITVOF fabric should have an average yarn spacing or separation ranging from about 3 μm to about 100 μm, including about 3 μm, about 4 μm, about 5 μm, about 6 μm, about 7 μm, about 8 μm, about 9 μm, about 10 μm, about 15 μm, about 20 μm, about 25 μm, about 30 μm, about 35 μm, about 40 μm, about 45 μm, about 50 μm, about 55 μm, about 60 μm, about 65 μm, about 70 μm, about 75 μm, about 80 μm, about 85 μm, about 90 μm, about 95 μm, or about 100 μm, inclusive of all ranges and subranges therebetween.

In various embodiments, the IR transmittance of the ITVOF fabric at wavelengths between about 5 μm to about 30 μm should range from about 30% to about 99%, including about 30%, about 35%, about 40%, about 45%, about 50%, about 55%, about 60%, about 65%, about 70%, about 75%, about 80%, about 85%, about 90%, about 95%, or about 99% inclusive of all ranges and subranges therebetween.

In various embodiments, the visible reflectance of the ITVOF fabric at wavelengths between about 300 nm to about 800 nm should range from about 40% to about 60%, including about 40%, about 45%, about 50%, about 55%, or about 60%, inclusive of all ranges and subranges therebetween.

In addition, a polyethylene-based ITVOF may not exhibit sufficient fabric handedness due to the nature of the material used. To ensure the fabric is comfortable to the wearer, it may be necessary for the fabric to be composed of a mixture of different material fibers which will affect the transmittance of the fabric. To assess the potential extent in which the transmittance will be reduced, simulations were also performed for different volumetric concentrations of polyethylene and polyester (PET) again assuming $D_f$=1 μm and $D_y$=30 μm. The optical constants for PET were also taken from the literature. For the most absorbing case of 25% PE/75% PET, the total hemispherical mid- to far-IR transmittance and reflectance was 0.728 and 0.038, respectively, which indicates that a fabric blend can still achieve a high transmittance and a low reflectance to provide sufficient cooling using thermal radiation.

The design for an infrared-transparent visible-opaque fabric (ITVOF) is demonstrated in order to provide personal cooling via thermal radiation from the human body to the ambient environment. The ITVOF design is developed to be made of polyethylene, which is an intrinsically low absorbing material, and structured the fibers to be sufficiently small in order to maximize the IR transparency and the visible opaqueness. For a 1 μm diameter fiber and a 30 μm diameter yarn, the total mid- and far-IR transmittance and reflectance are predicted to be 0.972 and 0.021, respectively, which exceed the minimum transmittance of 0.644 and maximum reflectance of 0.2 required to provide sufficient cooling at an elevated ambient temperature of 26.1° C. (79° F.). Simultaneously, the total hemispherical reflectance and transmittance in the visible wavelength range are comparable to existing textiles which indicates that the design is optically opaque to the human eye.

In some embodiments, the fibers of the ITVOF can comprise a single type of polymer, for example a polyester, a cellulose or other cellulosic fiber, a rayon (cellulose acetate), polyethylene, polypropylene, or a nylon, such as polycaprolactam. In other embodiments, the fibers can comprise two or more polymers, for example as a blend or in a bi-phasic structure such as a core-sheath structure.

In various embodiments, the ITVOF fabric can comprise a single type of yarn, wherein the yarn can comprise a single type of fiber, or can include different types of fibers in the same yarn. Alternatively, the ITVOF fabric can include two or more types of yarns, wherein the yarns can comprise the same or different types of fibers.

The ITVOF fabric of the present disclosure can be used to fabricate garments. Such garments can comprise only the ITVOF fabric, or can incorporate or combine the ITVOF fabric of the present disclosure with other suitable fabrics, whereby the ITVOF fabric provides personal cooling, while the other fabrics provide other mechanical, decorative, or functional properties.

The fabrication of an ITVOF can be achieved using conventional manufacturing processes including drawing, extrusion, or electrospinning. Thermal and mechanical evaluation can be conducted using standardized testing methods as shown in previous studies including the use of thermal manikins, wash and dry cycling, and subject testing, as described in the standard handbooks: ASTM D3995-14, Standard Performance Specification for Men's and Women's Knitted Career Apparel Fabrics: Dress and Vocational; ASTM Standard F1868, Standard Test Method for Thermal and Evaporative Resistance of Clothing Materials Using a Sweating Hot Plate; and ISO 11092 Textiles—Physiological Effects—Measurement of Thermal and Water-Vapour Resistance under Steady-State Conditions (sweating Guarded-Hotplate Test). Additionally, vapor transport through the fabric, which is another key component for thermal comfort, must also be considered in future ITVOF designs. Although the porosity of the proposed ITVOF design is based on typical clothing, e.g. within a range of about 0.1 to about 0.2, it would nonetheless be useful to quantitatively assess vapor transport to optimally design ITVOF-based clothing, according to the ASTM Standard E96/E96M, 2013, Standard Test Methods for Water Vapor Transmission of Materials, 2013. The inclusion of coloration for aesthetic quality is another important aspect that must be considered without compromising the effectiveness of radiative cooling. Alternative synthetic polymers, such as polypropylene or polymeric blends of UHMWPE and PET, are also suitable for use in an ITVOF design. Ultimately, ITVOF-based clothing offers a simple, low-cost approach to provide cooling locally to the human body in a variety of indoor and outdoor environments without requiring additional energy consumption, compromising breathability, or requiring any lifestyle change. Therefore, ITVOF provides a simple solution to reduce the energy consumption of HVAC systems by enabling higher temperature set points during the summer.

Suitable fabrication methodologies can include, for example the use a three step fabric production process consisting of (1) extrusion of a molten polymer through a spinneret into a bundle of fibers, (2) drawing of the fibers to reduce diameter and increase mechanical strength, and (3) spooling the fibers into a yarn. This fabrication method consists of combining spinneret-based polymer extrusion (widely utilized for polymer fiber production) with a drawing and fiber/yarn structuring system to create the ITVOF.

The design requirements (i.e., form factor, size, processing parameters, spinneret design, and system performance optimization) can be refined in order to fabricate the optimal ITVOF structure. Specifically, the system components (laboratory spinning machine and drawing system) can be designed, implemented and the resulting fiber performance can be tested under a range of temperature conditions. The disclosed designs can be utilized in a full-scale industrial implementation, but are exemplified herein using a prototype fabric (5 cm×5 cm) which represents a section of a full-scale garment. This exemplified equipment can be readily modified by the skilled artisan to meet the specifications required to produce the optimal ITVOF design in bulk.

Figure 8A:
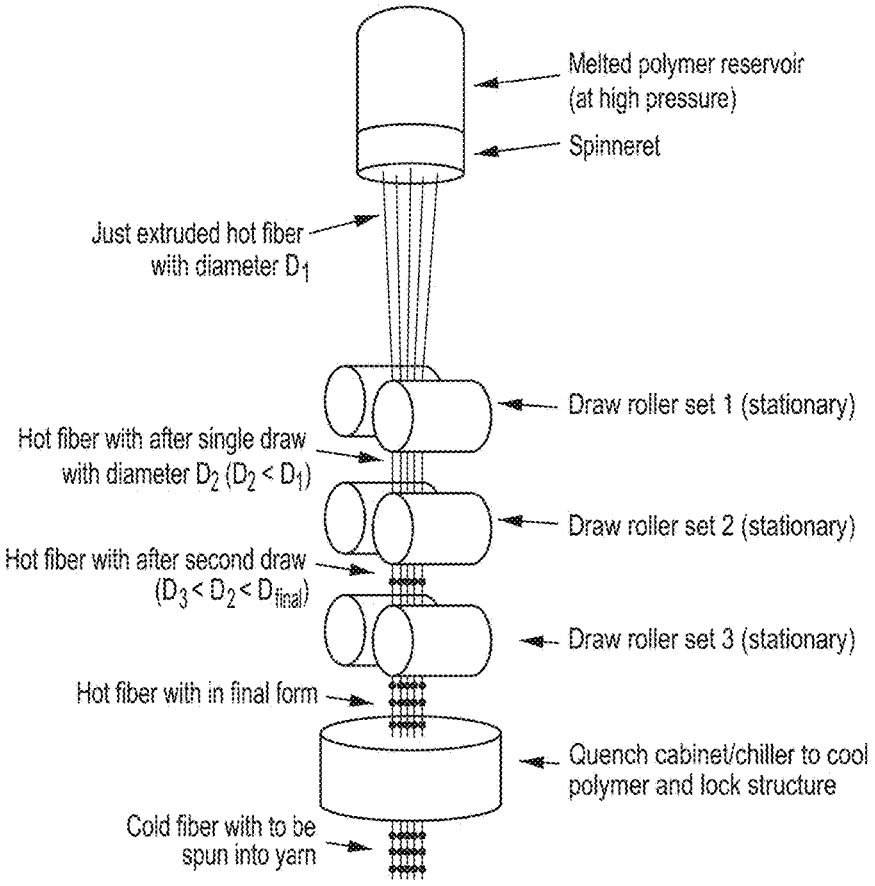
FIG. 8A illustrates a Yarn fabrication process.
Figure 8B:
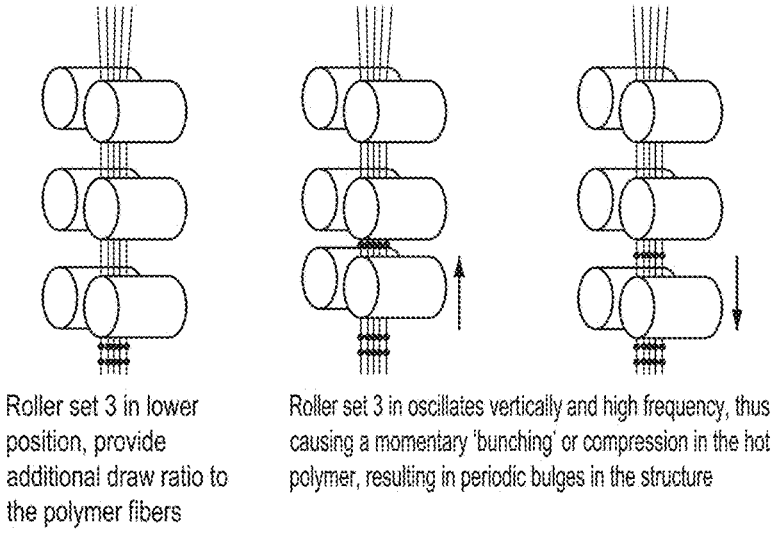
FIG. 8B illustrates a scheme used to introduce periodic bulges into yarn to control fiber separation.

The manufacturing scheme is illustrated in FIG. 8. In summary, a polymer powder is placed in a hopper and heated, resulting in melting of the polymer. A high pressure pump then forces the molten polymer through a spinneret extruding the polymer into fibers. The fibers exit the spinneret and proceed through a series of rollers which then draw the fibers in order to obtain the final diameter. The fibers are then collected and spooled into a yarn. The system is then modified to integrate some beads into the fiber to control the space between adjacent fibers for optimal porosity (FIG. 8*b*). Following spooling of the yarn, a separate process is carried out to weave the yarn into a fabric. The resulting ITVOF can then be colored either by the use of pigments mixed with the raw polymer or after weaving through the use of dyes or other coloring agents.

Nylon and polyethylene polymers exemplified herein are available from the Sigma Aldrich Company, but suitable commercial sources are well known to the skilled artisan. All samples are vacuum-dried at 110° C. for 24 h prior to being placed into the extruder for processing in order to reduce the moisture content of the polymer. Nylon is typically melt spun from the extruder at 230° C. Likewise, polyethylene is melt spun from the extruder at 140° C.

Figure 9A:
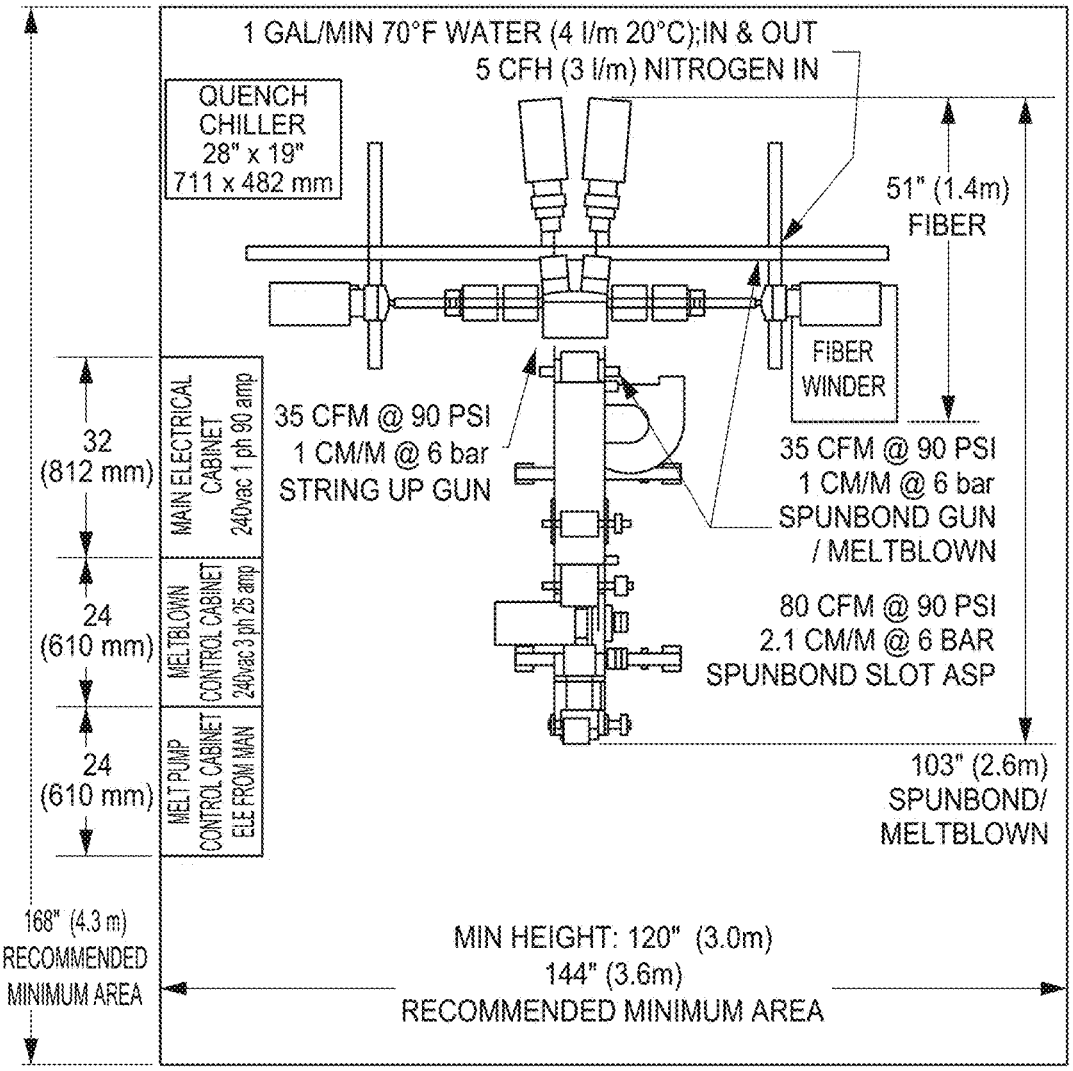
FIGS. 9A and 9B show a Hills, Inc. LBS-100 drawing machine.
Figure 9B:
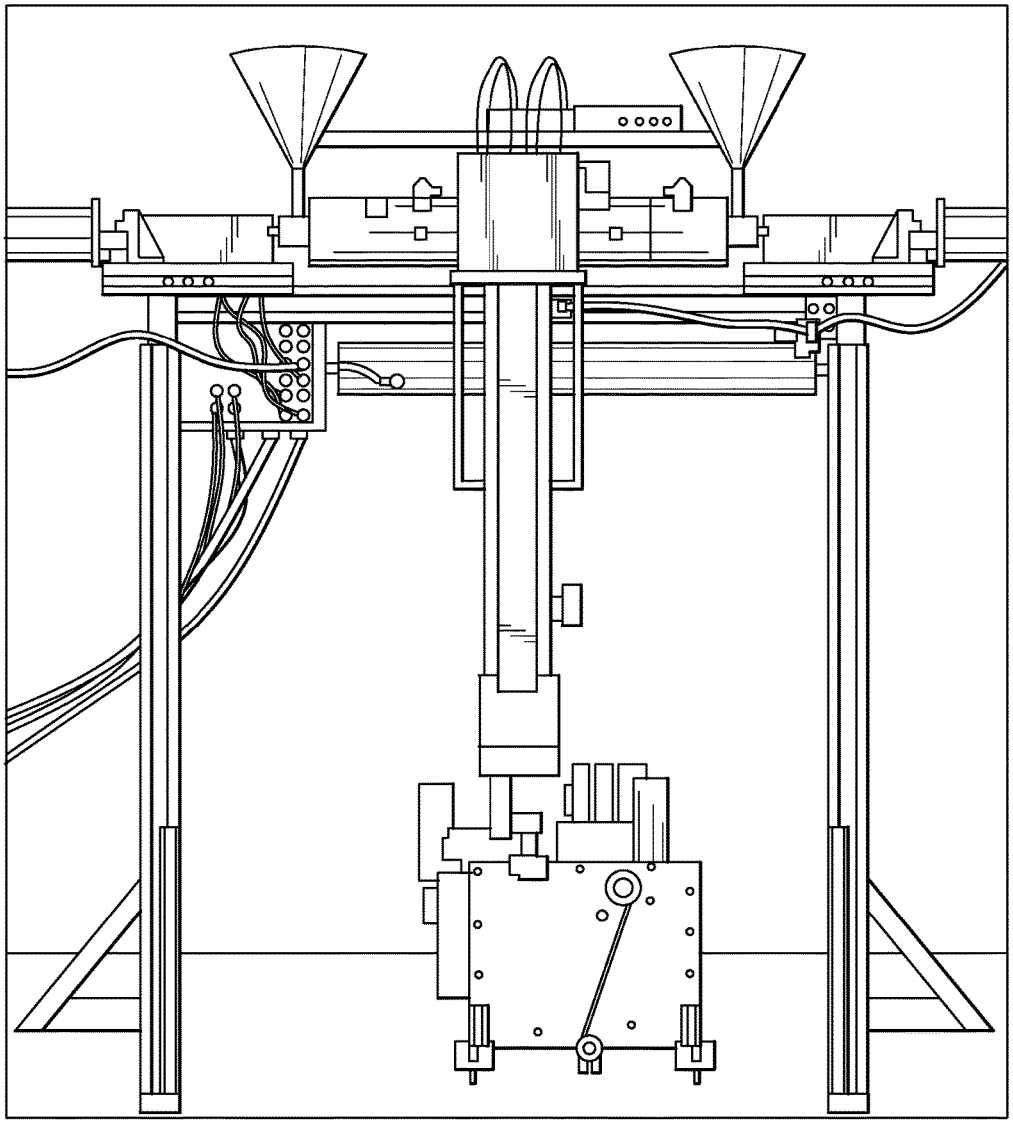

The exemplified system utilizes a laboratory scale spinneret machine (Hills, Inc. LBS-100, FIG. 9). This is a versatile machine, capable of producing high temperature polymer monofibers. The benefit of the drawing machine (LBS-100), and one of the main criteria in its selection, is in its inherent flexibility in terms of reconfiguration for research use. Spinneret blocks can be replaced or modified to alter the number of fibers, fiber diameter, and fiber cross-section. A spooling system is also included. Additionally, the system is a bi-component fiber machine, meaning that the dual extruders allow for polymer blends (or single polymers if both hoppers are loaded with the same material). The extruder operates at a nominal pressure of ~150 bar to produce a maximum rate of 5,000 m/h of fiber. While using an estimated 50-fiber yarn results in a production rate of ~100 m/h, a slightly lower rate of 10 to 20 m/h is used to support the production of consistent fiber diameters. The skilled artisan will appreciate that commercial fiber spinning machines are available which would provide analogous fibers for industrial scale production.

Figure 10:
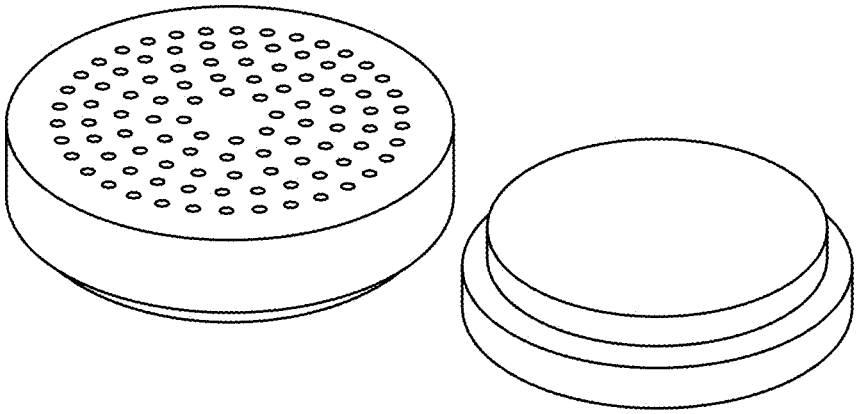
FIG. 10: Example blank and machined spinneret ready for use.
Figure 11B:
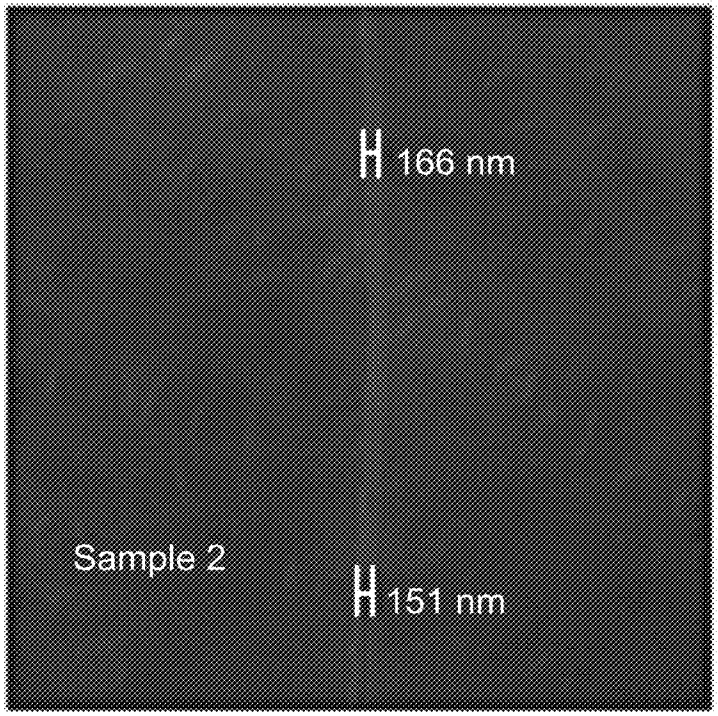
FIGS. 11A-11C show SEM images of fabricated nanofibers.
Figure 11A:
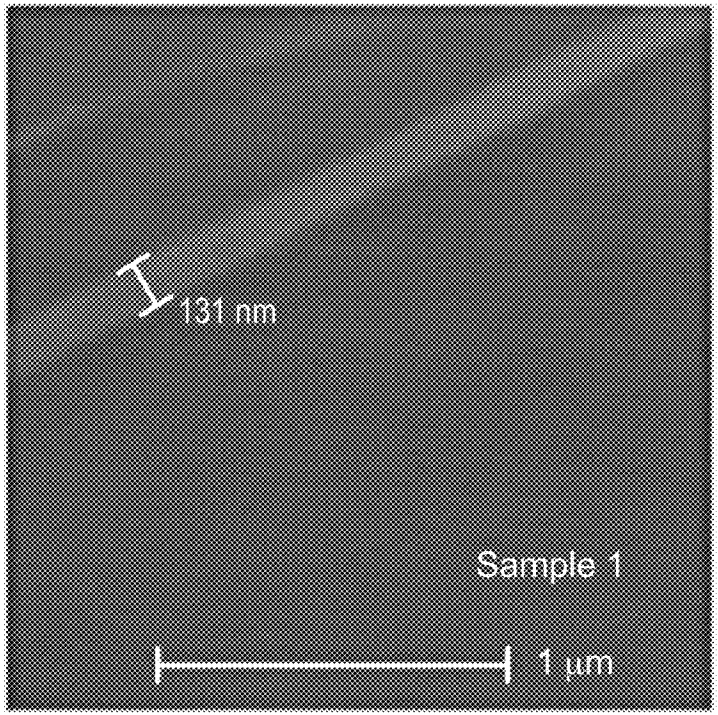
Figure 11C:
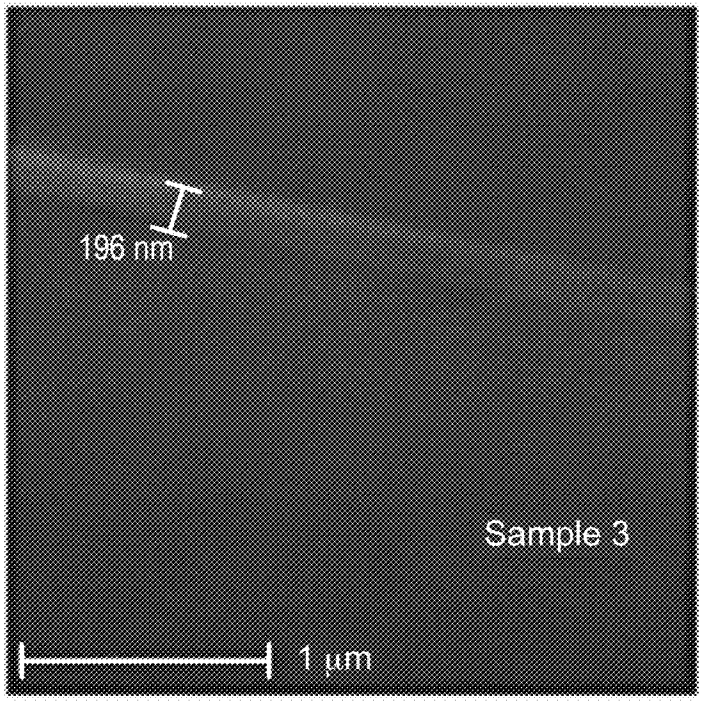
Figure 11D:
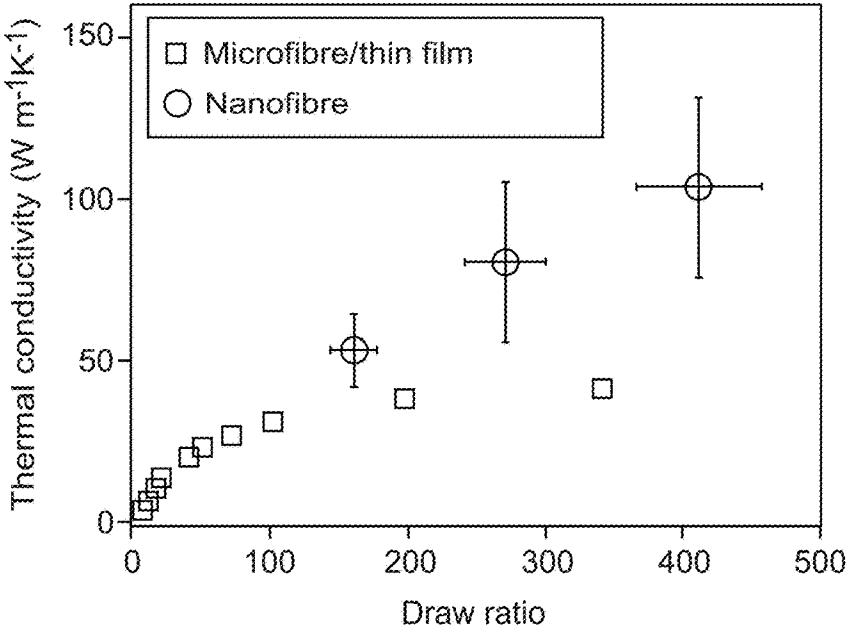
FIG. 11D shows thermal conductivity in fabricated nanofibers.

Once the optimal fabric design is determined, the extrusion spinneret, a multi-pore module through which melted polymer is extruded and machined to specification. FIG. 10 shows an example of a typical spinneret blank and machined spinneret. Fiber diameter is controlled through a combination of hole size (in the spinneret), and post extrusion drawing. The spinneret is designed to include the total number of fibers that comprise a single strand of yarn. In this manner, yarn production rate is equal to fiber production rate. It should be noted that the spinneret can be easily custom altered and is commercially available from several companies.

Generally, polymer fibers used in textiles are drawn after being extruded. This results in a number of improvements—first, it decreases the fiber diameter to the targeted value. Second, by drawing the fiber, it improves mechanical and durability properties of the fiber. Production of the ITVOF mates the spinning machine to a post-extrusion drawing system to draw the polymer fibers to the desired size and create the structure required to maintain fiber spacing in the yarn.

Polymer extrusion equipment and a method for the fabrication of polymer nanofibers with diameters between 50 and 500 nm are disclosed. These fibers exhibit ultra-high thermal conductivity (achieved through a drawing process) as shown in FIG. 11, and as described in the technology disclosed in Shen, S.; Henry, A.; Tong, J.; Zheng, R.; Chen, G. Polyethylene Nanofibres with Very High Thermal Conductivities. Nature Nanotechnology, 2010, 5, 251-255.

Figure 12A:
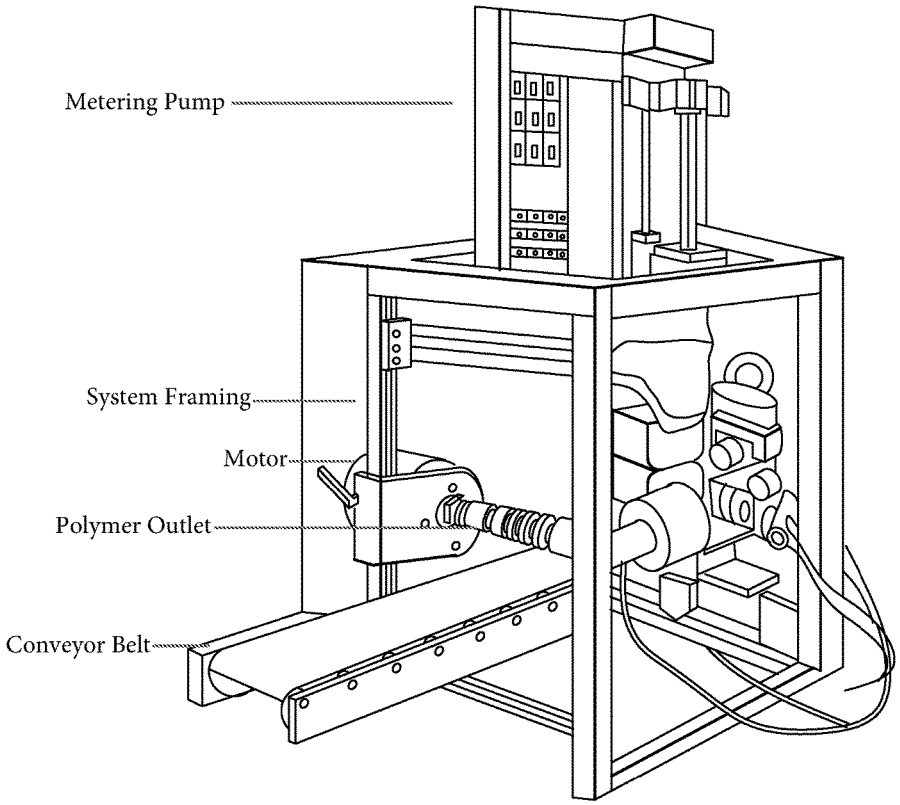
FIGS. 12A and 12B show an overview of a continuous polymer film drawing system developed.
Figure 12B:
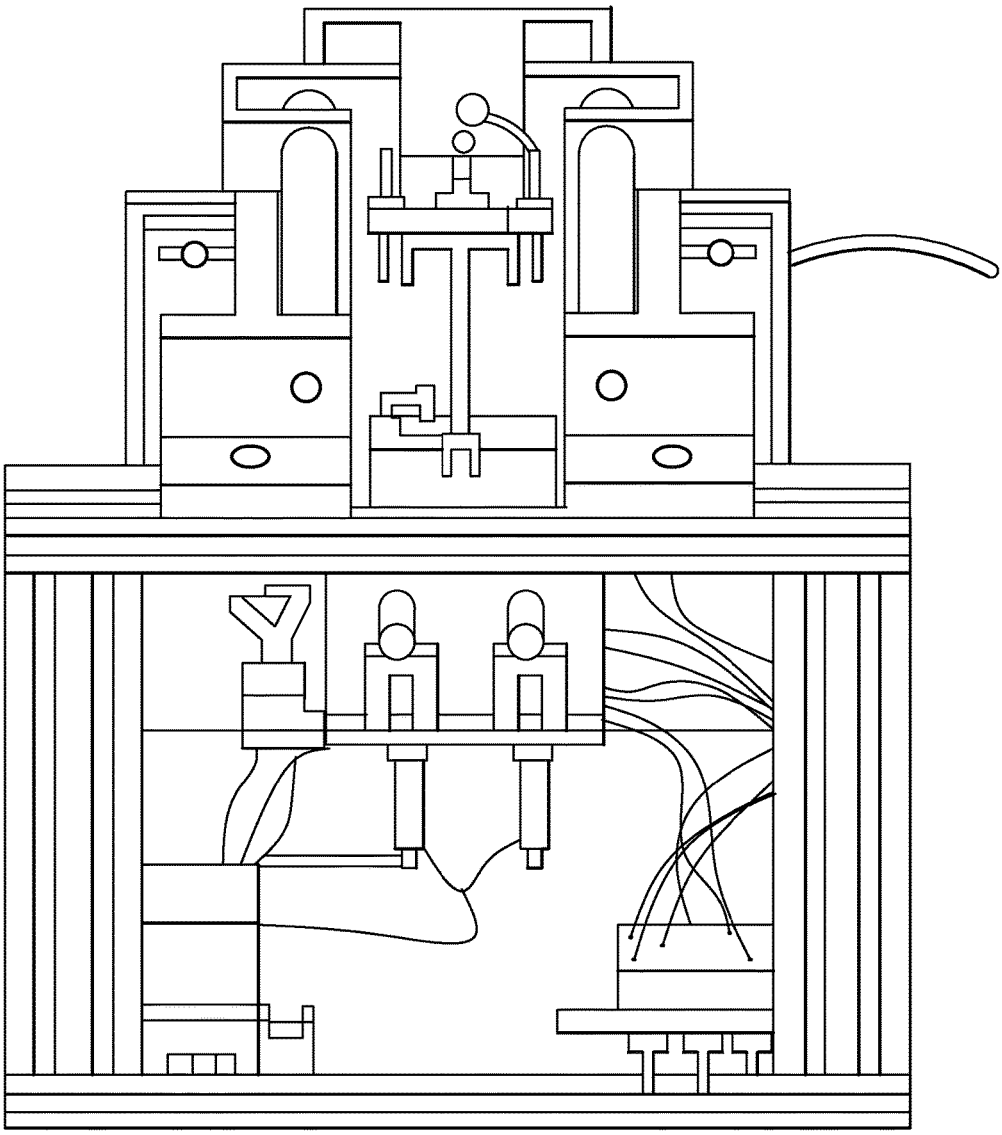
Figure 13:
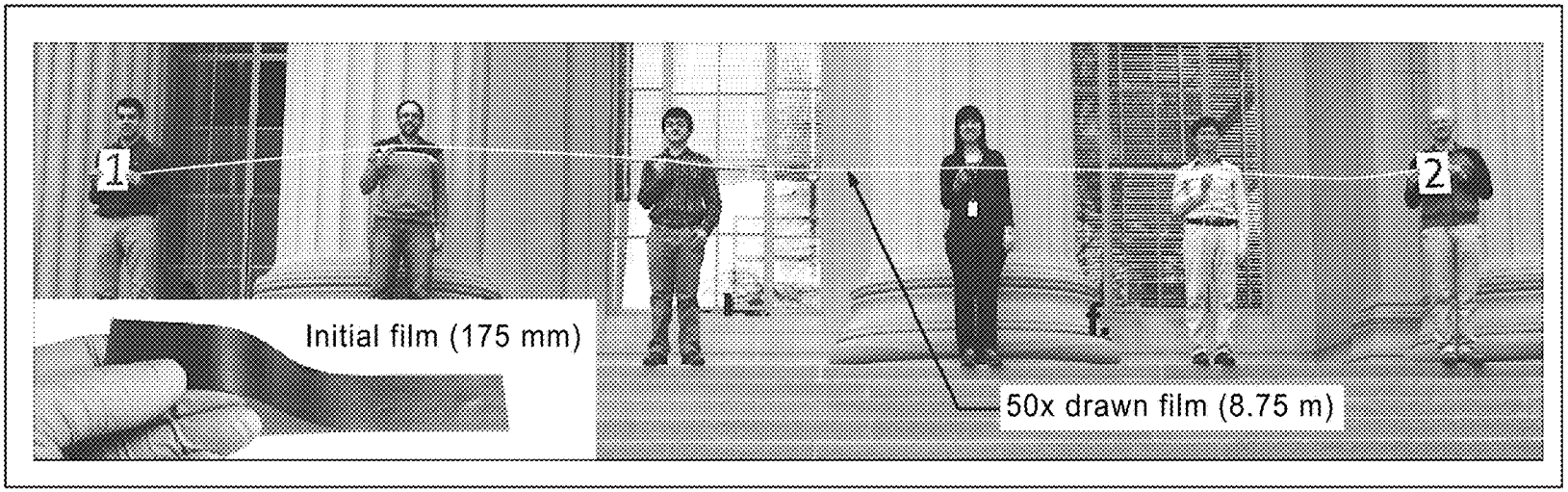
FIG. 13: Research group picture (and insert) demonstrating dramatic length change in initial 175 mm composite film drawn to 50× (final length 8.75 m, stretching from points '1' to '2').

More recently, a novel continuous fabrication process is developed to produce highly aligned polymer sheets, as described in Loomis, J.; Ghasemi, H.; Huang, X.; Thoppey, N.; Wang, J.; Tong, J. K.; Xu, Y.; Li, X.; Lin, C.-T.; Chen, G. Continuous Fabrication Platform for Highly Aligned Polymer Films. TECHNOLOGY 2014, 1-11. Alignment of molecular chains within polymers is a desirable trait for many applications as it results in superior mechanical and thermal properties in the polymeric materials. Therefore, fabrication techniques known in the art are directly applicable to the ITVOF fabrication as provided herein. FIG. 12 demonstrates the custom fabrication platforms developed and FIG. 13 shows a polymer film that was produced with a thermal conductivity two orders of magnitude higher than bulk materials.

Figure 14:
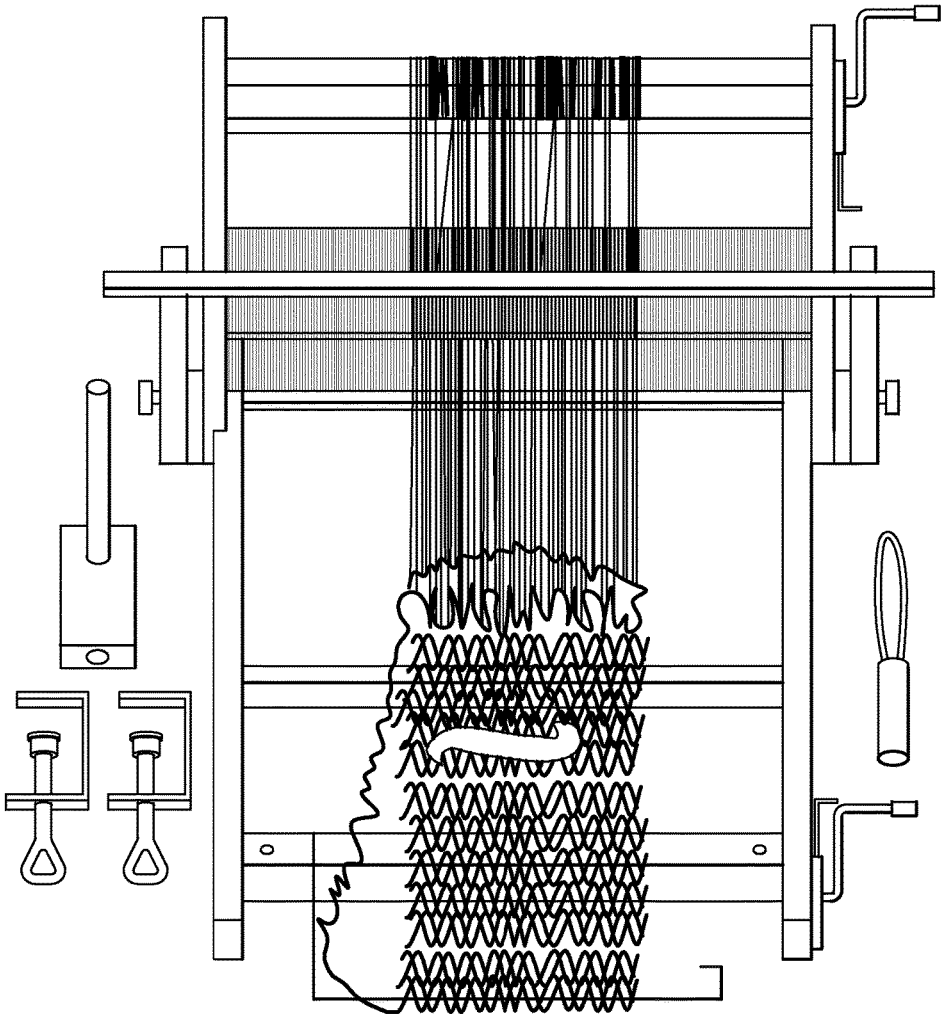
FIG. 14: Image of Glimakra Emilia rigid heddle loom.

Once a spool of yarn is created using the developed approach, the next step is to weave this yarn into a fabric. In order to accomplish this task, a yarn is woven using commercially available looms (Glimakra Emilia rigid heddle loom) to create initial prototypes. In this manner, several weaving patterns can be explored to assess cooling, strength, and comfort. The loom, as shown in FIG. 14, is a tabletop machine capable of producing 33 cm (13 inch) wide samples. The skilled artisan will recognize that commercial scale looms can be used to produce ITVOF fabrics at large scale, and that various conventional weaving patterns are suitable.

The process to color ITVOF will depend on the material components being dyed (nylon, polyethylene, etc.). Colorants are typically divided into two major classes: dyes and pigments. The demarcation between them is based chiefly on solubility. A pigment relies on insolubility in the medium in which it is dispersed, while a dye requires some degree of solubility that will allow it to diffuse into the polymeric matrix of a textile fiber.

According to the different interaction between the dyes and fiber/yarn/fabric, strategies to color nylon/polyethylene fabric are classified into the following classes: (a) dyes exploiting hydrogen bonding between electron donating nitrogen atoms (—N:) in the dye and polar —OH or —CONH— groups in the fabric, (b) charged, water-soluble organic dyes that bind to ionic and polar sites on fabric molecules, and (c) dyeing with inorganic pigments or the precipitation of metal salts on fibers (mineral dyes).

Nylon fibers are hydrophilic and they absorb water readily. The model for the uptake of dyes by these fibers is thus one of water-filled pores through which soluble dye diffuses. In the internal phase these dyes can interact with the nylon chain via a hydrogen bond. In contrast, polyethylene fibers are hydrophobic and absorb comparatively little water. In order to dye polyethylene fibers, the following coloration methods are being considered. One is adding pigment at the stage of fiber formation, and the other is chemical modification of the fibers. The second method has disadvantages such as the loss of the typical properties of the fibers by chemical modification and low color fastness. It is more realistic to consider a "dyeing transition temperature," which is defined by a temperature at which there is a rapid increase in the rate of dye/pigment diffusion through a polymer. As these fibers are typically thermoplastic, they undergo a glassy-rubbery transition at a characteristic temperature (Tg). Above this temperature the polymer chain segments are mobile, and at any given time there is a free volume within the polymer matrix. The fiber is thus better regarded as a system of continuously changing regions of "free volume" through which pigments can diffuse.

Figure 15:
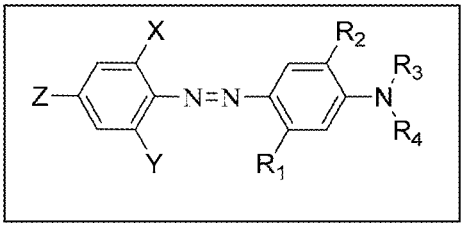
FIG. 15: The general structure of azo dyes.
Figure 16:
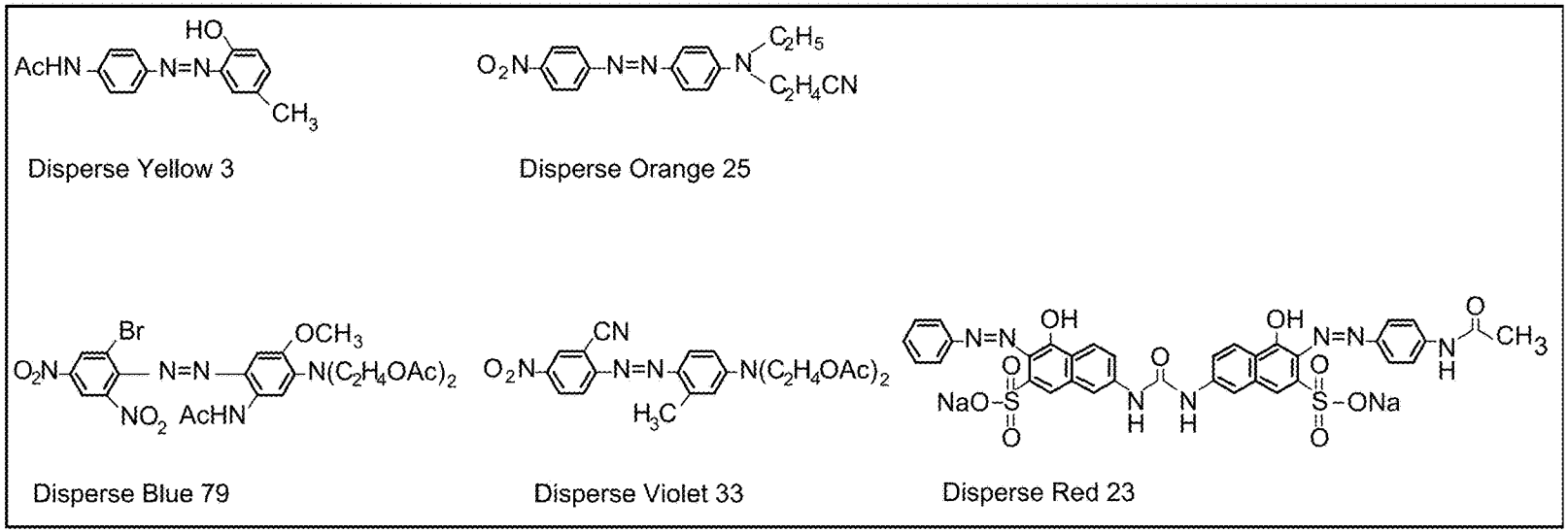
FIG. 16: Chemical structures for typical azo dyes.

Azo dyes from blue to red can be considered as colorants for this project. The azo group is an inherently intense chromophore in terms of tinctorial strength, the cost of manufacturing azo dyes is comparatively lower than other expensive dyes. Azo dyes are defined as compounds containing at least one azo group attached to sp2-hybridized carbon atoms, such as benzene, naphthalene, thiazole and thiophene. As a typical donor-acceptor chromogen, the electron-accepting substituents, X, Y and Z and the electron donating substituents R1 and R2 are favorably sited to create visible colors as shown in FIG. 15. Azo dyes cover a whole gamut of colors as shown in FIG. 16, from blue to red hues, by varying the intermediates especially when heterocyclic diazo components are coupled to aminobenzene couplers substituted with powerful electron donating groups, giving bright blue colors, according to Sigma Aldrich, Online Catalog. The skilled artisan will appreciate that any suitable dye can be used, as described herein.

Figure 17A:
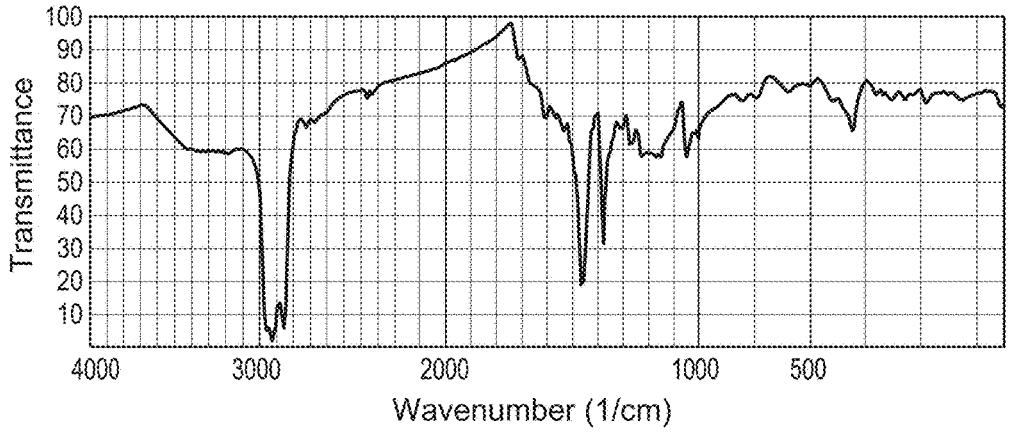
FIGS. 17A and 17B show optical properties of Direct Red 23 azo dye.
Figure 17B:
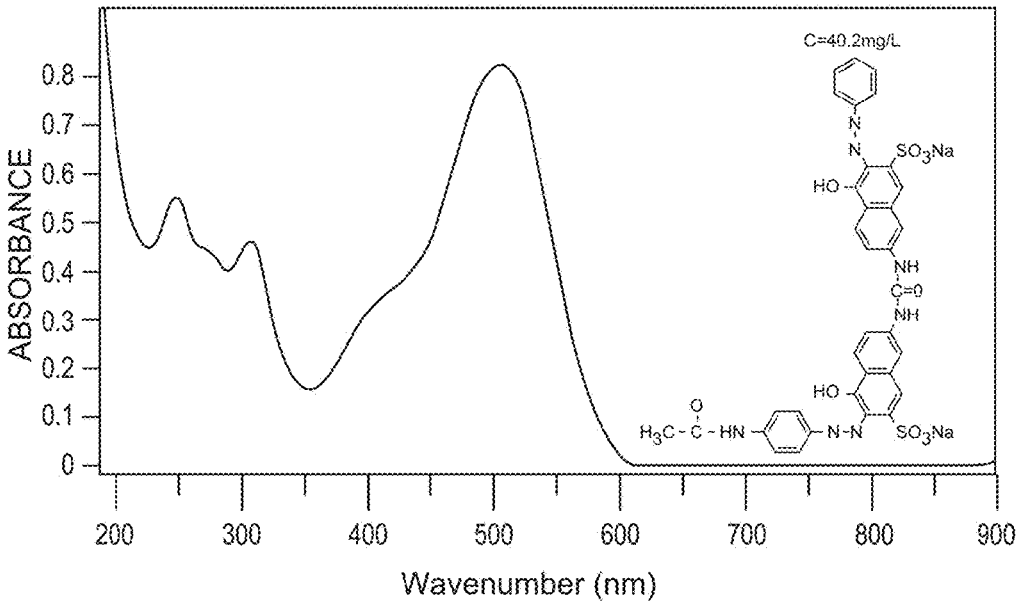

The sheer variety of azo dyes requires additional investigation to assess suitability for IR transmissivity. As an example, the FTIR transmittance spectrum is plotted for a common azo dye known as Direct Red 23 in FIG. 17*a*. As shown, this dye exhibits distinct absorption peaks in the 5-10 μm range which is consistent with many azo dyes. However, at wavelengths longer than 10 Direct Red 23 dye exhibits very few absorption peaks suggesting that this dye could be used to color ITVOF without severely decreasing IR transmittance. The dye's corresponding UV-Vis absorbance is shown in FIG. 17*b*, according to Green, F. J. The Sigma-Aldrich Handbook of Stains, Dyes, and Indicators; Gurr, E. Encyclopedia of Microscopic Stains; Hill: London, 1960; p. 72; and Emig, W. H. Stain Techniques; Science Press: Pittsburgh, 1941.

To assess the suitability of ITVOF for clothing with enhanced cooling power, several key properties can be measured. These properties are generally grouped into four main areas: (1) structural properties of fabricated ITVOF, (2) the opaqueness and transparency of ITVOF in the visible and IR wavelength range, respectively, (3) the improvement in cooling power due to the inclusion of radiative heat transfer and thermal comfort, and (4) the mechanical robustness and comfort of ITVOF. In accordance with the DELTA-FOA program's performance metrics for wearable technologies, the intended performance objectives for technology are summarized in Table 1 as follows.

TABLE 1

DELTA-FOA Performance metrics for proposed ITVOF.

| ID | Property | Metric | ITVOF Target |
|---|---|---|---|
| 3.1 | Thermal Performance | >23 W cooling power per occupant | >23 W (shirt/pant combination) |
| 3.2 | Minimum COP | 0.35 (minimum) | ∞ (no power consumption) |
| 3.3 | Range of Motion | Entire building interior | No limitations range of motion |
| 3.4 | Cost | <10% of selling price increase over baseline apparel assuming a 4° F. setpoint expansion for technologies that only cool. | <10% of selling price increase over baseline apparel assuming a 4° F. setpoint expansion for technologies that only cool |
| 3. 5 | Operability | Fully autonomous, optional capability for occupant override, and communication with the building. | Fully passive system. No occupant override or building communication needed. |
| 3.6 | Safety | Meet OSHA standards. | Meet OSHA standards. |
| 3.7 | Durability | Meet ASTM standards of 50 washing and drying cycles. | Exceed ASTM standards. |
| 3.8 | Appearance | Detachable from current apparel. Exhibits no visible surface change. Exhibits no interference with consumer color or texture choices. Requires negligible power. | The proposed technology will be the apparel. Exhibits no visible surface change. Multiple color choices and texture options based on weave. No power is consumed. |
| 3.9 | Weight | <10% Increase over baseline apparel | <10% increase over baseline apparel. |
| 3.10 | Interaction with building | Preferred to provide temperature and humidity information to the building. | Fully passive system. Will not provide information to the building. |

Structural characterization of the ITVOF can be carried out assess morphology, size, uniformity, and porosity of individual fiber, yarn, and fabrics mainly based SEM imaging. Since fiber pulling can create certain degree of molecular alignment that affect mechanical properties, XRD spectroscopy can be used to assess the crystallinity of the fibers.

The complex interactions between human body, fabric and the ambient environment define the thermal comfort performance. This is critical in influencing product acceptance by the end customer. Often perceptions of discomfort are sensed when clothing impedes the flow of heat and moisture from the body. The principle that governs thermal comfort is the balance of the body heat generation and dissipation as well as the balance of the body water vapor generation and removal. Thus the assessment of thermal comfort performance is primarily heat and moisture transport through the fabric into a controlled environment. With a fixed temperature difference between skin and ambient, the thermal and evaporative resistance should be in a certain range to create heat and moisture balance allowing for optimal comfort.

Figure 18A:
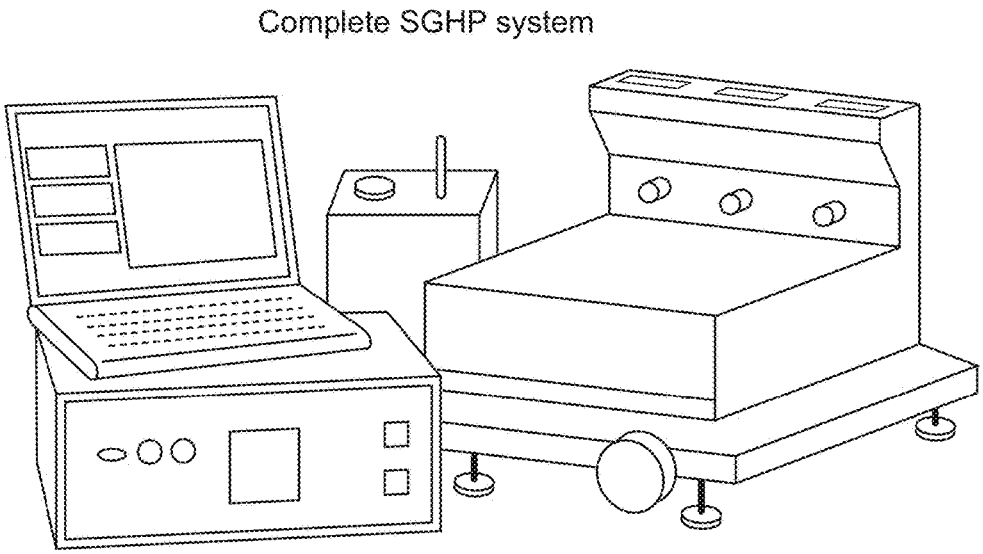
FIG. 18A shows the complete SGHP system for measurement of thermal resistance of fabrics.
Figure 18B:
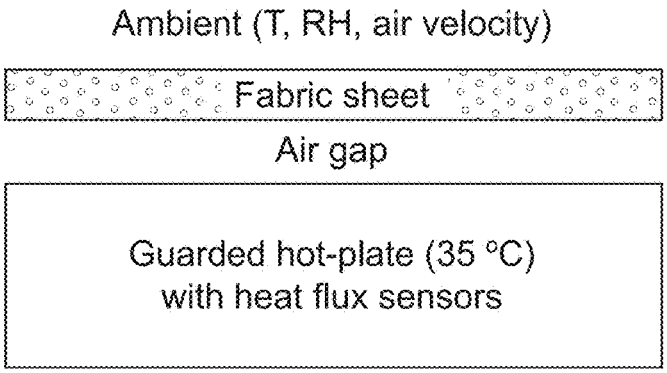
FIG. 18B shows the scheme for the principle of the measurement.
Figure 19:
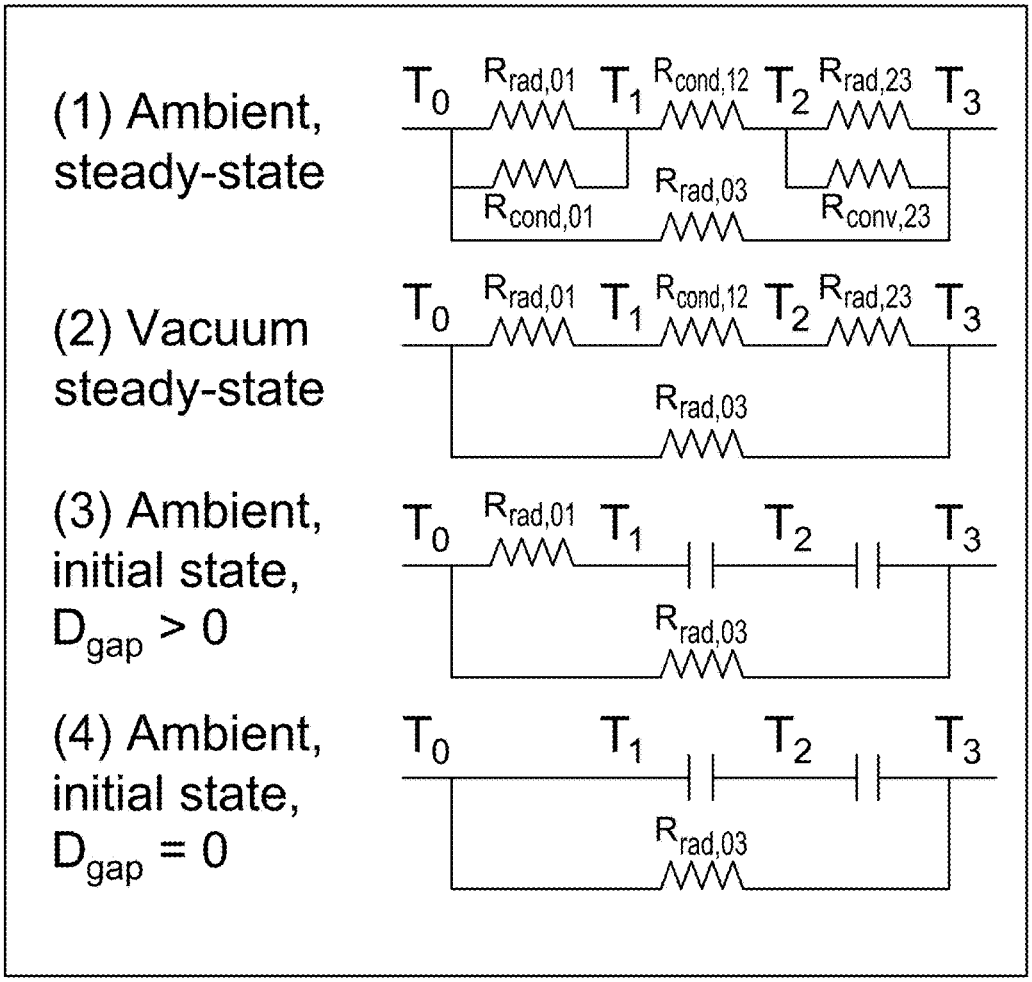
FIG. 19: The equivalent thermal resistance networks for heat transfer model defined in FIG. 18*b* at different conditions which are employed to separate the conduction, convection and radiation components from the total thermal resistance and assess their individual impact.

The thermal resistance can be measured utilizing a well-established guarded hot-plate technique (FIG. 18). A commercial system can be used such as the sweating guarded hot-plate (SGHP) system (Measurement Technology Northwest, Inc.) that measures the thermal resistance of fabrics at various conditions like different humidity, different sweating level and contact/noncontact situation. This is used to determine different contributions to heat transfer such as conduction, convection, radiation, and moisture transport (FIG. 19). The system and measurement procedures are in accordance with the requirements of ASTM F1868, Standard Test Method for Thermal and Evaporative Resistance of Clothing Materials Using a Sweating Hot Plate; or ISO 11092 Textiles—Physiological Effects—Measurement of Thermal and Water-Vapour Resistance under Steady-State Conditions (sweating Guarded-Hotplate Test). In combination with the system, thermal and radiative properties of the fabrics are measured to decouple contributions to heat flow from radiation, convection, and vapor transport, as described in Kraemer, D.; Chen, G. A Simple Differential Steady-State Method to Measure the Thermal Conductivity of Solid Bulk Materials with High Accuracy. Review of Scientific Instruments. 2014, 85, 025108, and Ghasemi, H.; Ni, G.; Marconnet, A. M.; Loomis, J.; Yerci, S.; Miljkovic, N.; Chen, G. Solar Steam Generation by Heat Localization. Nature Communications, 2014, 5, 4449.

Figure 20A:
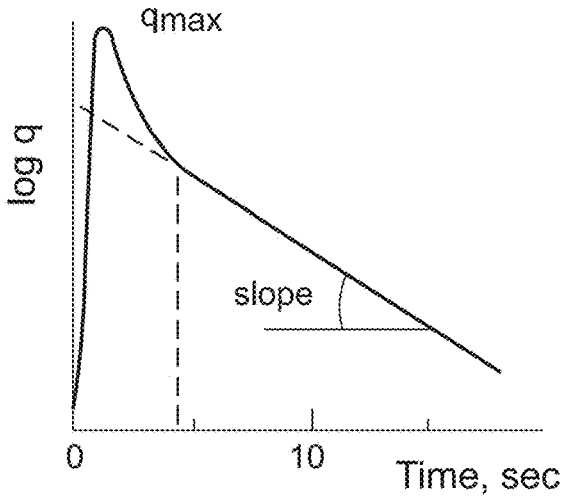
FIG. 20A shows a typical curve of heat flux along time between a hot object and a cold object under the condition that the hot object is kept constant.
Figure 20B:
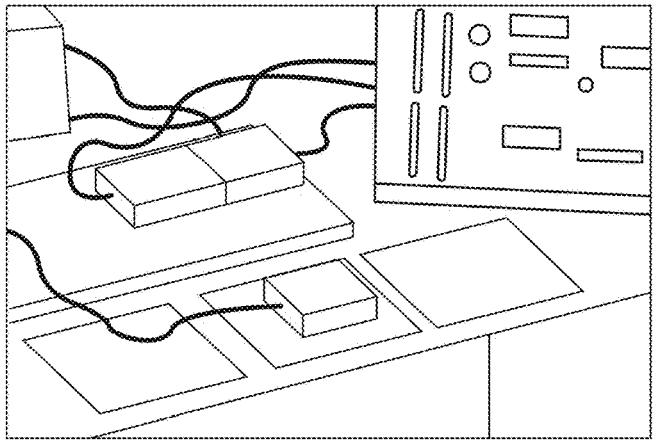
FIG. 20B shows the instrument THERMO LABO II to evaluate the warm-cool feeling of fabrics.
Figure 20C:
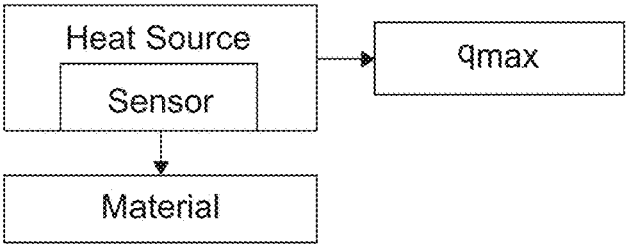
FIG. 20C is an illustration of the experiment setup.

In addition, the instantaneous thermal sensation experienced at the initial contact of the material fabric with the skin surface can also be important to an individual's comfort. To assess the warm and cool sensations of a garment fabric, Japan JIS Qmax standard, as described for example by Yoneda, M.; Kawabata, S. Analysis of Transient Heat Conduction and Its Applications. Journal of the Textile Machinery Society of Japan, 1983, 29, 73-83) is followed to setup for the testing system for the samples. To assess this parameter, a commercially available instrument (Model KES-F7 THERMO LABO II, KATO TECH CO., LTD.) as shown in FIG. 20 can be used.

Figure 21:
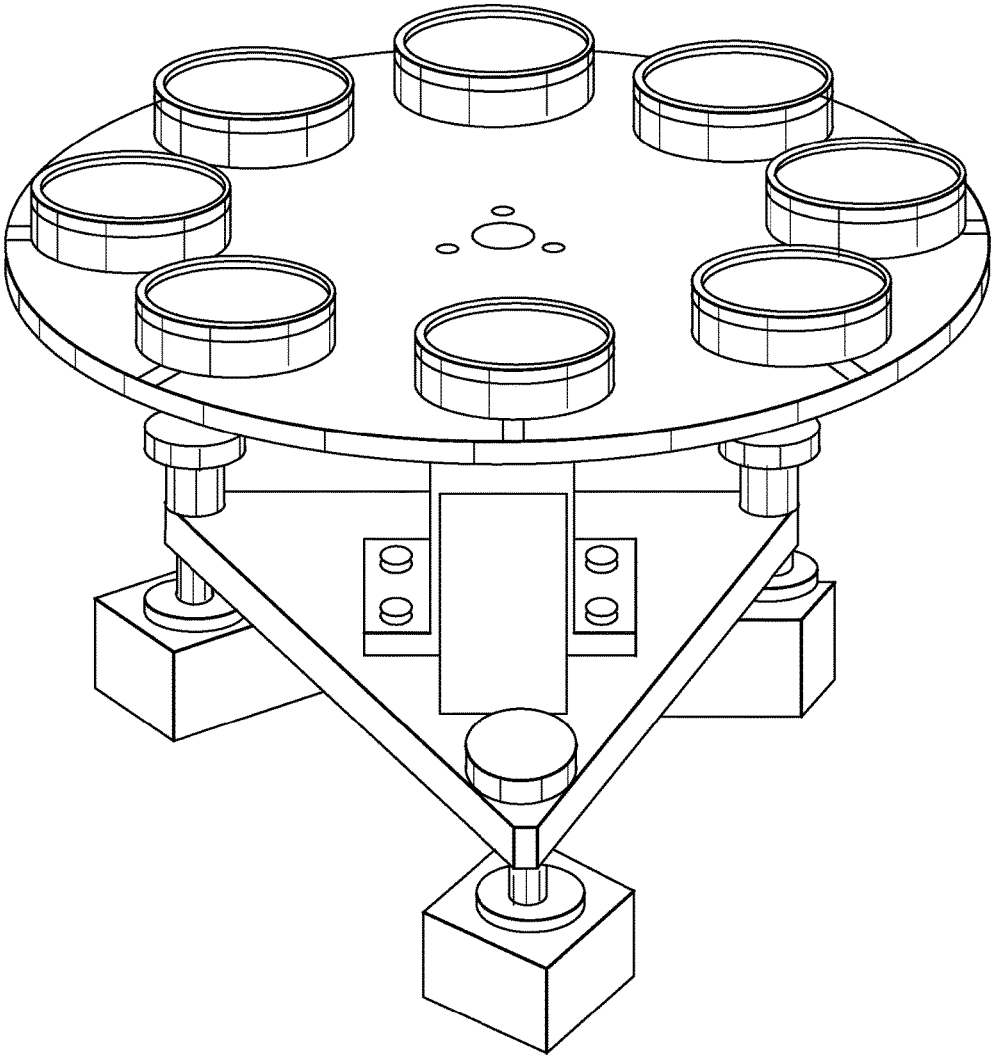
FIG. 21: The instrument for moisture vapor transmission rate measurement based on simple dish method.

In clothing, the moisture vapor transmission rate (MVTR) is a measure of breathability and has contributed to greater comfort for wearers of clothing for moderate activity rate. It is measured by the mass rate in which water vapor passes through fabrics, in grams of water vapor per square meter of fabric per 24 hour period ($g/m^2/day$). This property is measured using a commercial system according to the simple dish method, similar to ASTM Standard E96/E96M, 2013, Standard Test Methods for Water Vapor Transmission of Materials, 2013. A typical instrument is shown in FIG. 21.

The mechanical characterization of the ITVOF is intended to assess its mechanical strength and lifetime stability under various loading configurations. The evaluation of the mechanical properties of the ITVOF follows ASTM standards for woven textiles. Specifically, the tensile strength is evaluated using Instron testing machines. To assess color fastness and fabric robustness, the ITVOF is washed and dried at least 50 times in accordance to ASTM standards D3995-14, Standard Performance Specification for Men's and Women's Knitted Career Apparel Fabrics: Dress and Vocational. For mechanical comfort performance, an industry CSP adviser is consulted to evaluate the ITVOF handedness. These measurements are conducted in conjunction with characterization, and modeling is carried out in parallel to provide systematic iteration to determine optimal ITVOF design for mechanical robustness and comfort.

UV/Visible Characterization

A custom UV/visible wavelength spectrometer was used to measure the optical properties of the fabric samples in the visible wavelength range. This system consisted of a 500 W mercury xenon lamp source (Newport Oriel Instruments, 66902), a monochromator (Newport Oriel instruments, 74125), an integrating sphere (Newport Oriel Product Line, 70672) and a silicon photodiode (Newport Oriel instruments, 71675). Total hemispherical reflectance measurements were performed by placing the fabric samples onto a diffuse black reference (Avian Technologies LLC, FGS-02-02c) to avoid reflection from the underlying substrate. Total hemispherical transmittance measurements were performed by placing the fabric samples onto the input aperture of the integrating sphere. All measurements were calibrated using a diffuse white reference (Avian Technologies LLC, FWS-99-02c).

Infrared Characterization

A commercially available FTIR spectrometer (Thermo Fisher Scientific, Nicolet 6700) and an IR objective accessory (Thermo Fisher Scientific, Reflachromat 0045-402) was used to measure the optical properties of the fabric samples and the polymer films in the infrared wavelength range. The objective was placed 15 mm behind the samples, corresponding to the working distance of the objective, in order to capture infrared radiation transmitted through the samples. For the fabric samples, the total hemispherical transmittance will be underestimated since not all of the IR radiation that is diffusively transmitted through the fabric sample is captured. However, the objective used in this study was designed to capture IR radiation at a 35.5° acceptance angle. Since it is expected that IR radiation will transmit diffusively, the measured results are likely underestimated by a few percent, which is still in agreement with previous studies.

The following passages include supporting information which provides further details on the heat transfer modeling, the optical constants of polyethylene (PE) and polyethylene terephthalate (PET), Mie theory calculations for a single isolated polyethylene fiber, numerical finite element simulations of a polyethylene-based ITVOF for a larger yarn diameter, and numerical finite element simulations for an ITVOF blend of polyethylene and polyester.

Heat Transfer Model

To evaluate the impact of a fabric's IR optical properties on personal cooling, a 1D steady-state heat transfer model was adopted, as illustrated in FIG. 1*a* of the main text. This model combines a control volume analysis and an analytical formulation of the temperature profile within the fabric to analyze heat dissipation from a clothed human body to the ambient environment. Radiative, conductive, and convective heat transfer are all included in this analysis. For convenience, the following denotations are used in this model: 0—surface of human skin, 1—inner surface of the fabric, 2—outer surface of the fabric, and 3—the ambient environment. The following sections provide a summary of the assumptions, input parameters, and a derivation of the analytical formulas used in this analysis.

Assumptions

For convenience, all assumptions in the model are summarized as follows, (1) In general, the human body can be modelled as a cylinder with a 1 m diameter. In this analysis, the air gap thickness, $t_a$, and fabric thickness, $t_c$, are assumed to be much smaller compared to the diameter. Therefore, curvature effects are assumed to be negligible, thus heat transfer is modelled as 1D transport through parallel slabs. In this analysis, heat transfer is expressed as area-normalized heat fluxes.

(2) The human body is assumed to be in a sedentary state with a uniform skin temperature and heat generation.

(3) The fabric is assumed to cover 100% of the human body.

(4) The air between the skin and fabric is assumed to be stationary thus convective heat transfer is negligible in this region.

(5) Air circulation through the fabric is neglected.

(6) All optical properties are assumed to be gray and diffuse.

(7) The skin and environment are assumed to be an ideal blackbody emitter and absorber.

(8) An average fabric temperature (e.g. mean of $T_1$ and $T_2$) is assumed for thermal emission by the fabric.

(9) All radiative view factors are equal to 1.

(10) Internal scattering and self-absorption effects are neglected within the fabric.

(11) It is assumed the absorption and emission profile is linear within the fabric. This is an approximation of the more rigorous exponential profile that governs absorption and emission when internal scattering is negligible. In the limit of either high fabric transmittance or reflectance, this is a reasonable assumption due to the linearity of the exponential decay. In the limit of high absorptance, this assumption will no longer be accurate. Despite this, the cooling power and the maximum ambient temperature can still be reasonable predicted since the difference between the inner and outer fabric temperatures is expected to be small.

Input Parameters

Table 2 shows a list of the input parameters used in this study. In order to determine the total cooling power through the fabric, the net heat flux in this analysis can be multiplied by the surface area of the human body, A.

Additionally, the fabric is assumed to be partially reflective, transmissive, and absorptive with gray and diffuse optical properties. In conjunction with Kirchoff's law, the fabric's optical properties will adhere to the following relation, $$\epsilon_c=\alpha_c=1-\rho_c-\tau_c \tag{S1}$$

where $\epsilon_c$, $\alpha_c$, $\rho_c$, and $\tau_c$ are the fabric's total hemispherical emittance, absorbance, reflectance, and transmittance, respectively.

TABLE 2

Input Parameters

| Parameter Name | Value | Parameter Name | Value |
|---|---|---|---|
| Human body surface area, A | 1.8 $m^2$ | Fabric thickness, $t_c$ | 0.5 mm |
| Heat generation rate, $q_{gen}$ | 58.2 $W/m^2$ | Total einittance of skin | 1 |
| Skin temperature $T_0$ | 33.9° C. (93° F.) | Total emittance of environment | 1 |

TABLE 2-continued

| Input Parameters | | | |
|---|---|---|---|
| Parameter Name | Value | Parameter Name | Value |
| Thermal conductivity of air, $k_a$ | 0.027 $Wm^{-1}K^{-1}$ | Conv. heat transfer coeff., h | 3-5 $Wm^{-2}K^{-1}$ |
| Thermal conductivity of yarn, $k_y$ | 0.05 $Wm^{-1}K^{-1}$ | Air gap thickness, $t_a$ | 1.05-2.36 mm |
| Fabric porosity | 0.15 | Fabric reflectance, $\rho_c$ | 0-1 |
| Thermal conductivity of fabric, $k_c$ | 0.047 $Wm^{-1}K^{-1}$ | Fabic transmittance, $\tau_c$ | 0-1 |

Model Formalism

In this model, the overall goal is to determine the maximum ambient temperature that can be sustained without compromising a person's thermal comfort as a function of the fabric's optical properties. Although a minimum ambient temperature also exists, this is related to personal heating and is thus beyond the scope of this work. The criterion used to evaluate personal thermal comfort is based on the equivalence of the total cooling power with the total heat generation rate of 105 W from the human body. For a given set of material and environmental conditions, the ambient temperature is increased iteratively until the net cooling power can no longer dissipate the amount of heat generated by the human body. By fixing the skin temperature to be 33.9° C. (93° F.), the primary unknown variables in this model are the inner surface fabric temperature, $T_1$, the outer surface fabric temperature, $T_2$, and the ambient temperature, $T_3$.

Additionally, the air gap thickness, $t_a$, and the convective heat transfer coefficient, h, can also be varied to simulate different environmental conditions (i.e. tight-fitting vs. loose fitting fabric on different areas of the human body, varying levels of air circulation within the ambient environment, etc.) independent of the environment temperature. In order to compare the impact of the fabric's optical properties on personal cooling for various environmental conditions, the air gap thickness and convective heat transfer coefficient are constrained to ensure a consistent baseline neutral temperature band is used regardless of the environmental conditions. To accomplish this, a reference case is adopted to assume an ambient temperature of 23.9° C. (75° F.), corresponding to the upper limit of a typical neutral temperature band. The reflectance and transmittance of the fabric are also assumed to be $\rho_c$=0.3 and $\tau_c$=0.03, respectively, corresponding to measurements of conventional polyester and cotton fabrics as shown in FIG. 2 of the main text. Under these conditions, the convective heat transfer coefficient is chosen and iterated the air gap thickness until the total cooling power exactly balances the total heat generation rate using the model equations as shown below. In this manner, the maximum ambient temperature for various environmental conditions and conventional clothing is always 23.9° C. (75° F.). Thus, any subsequent improvements can only be attributed to radiative cooling through the fabric. This work assumes that an individual is cooled via natural convection, thus the convective heat transfer coefficient has a typical range of 3-5 $W/m^2K$ with a corresponding air gap thickness of 1.05-2.36 mm.

In various embodiments, the ITVOF fabrics of the present disclosure should have an IR reflectance ranging from about 1% to about 25%, for example about 1%, about 2%, about 3%, about 4%, about 5%, about 6%, about 7%, about 8%, about 9%, about 10%, about 11%, about 12%, about 13%, about 14%, about 15%, about 16%, about 17%, about 18%, about 19%, about 20%, about 21%, about 22%, about 23%, about 24%, or about 25%, inclusive of all ranges and subranges therebetween. In particular embodiments, the IR reflectance is less than about 10%.

In other embodiments, the ITVOF fabrics of the present disclosure should have an IR transmittance between about 5 μm and about 30 μm ranging from about 30% to about 99%, for example, about 30%, about 31%, about 32%, about 30 through 34, 5%, about 36%, about 37%, about 38%, about 39%, about 40%, about 41%, about 42%, about 43%, about 44%, about 45%, about 46%, about 47%, about 48%, about 49%, about 50%, about 51%, about 52%, about 53%, about 54%, about 55%, about 56%, about 57%, about 58%, about 59%, 60%, about 61%, about 62%, about 63%, about 64%, about 65%, about 66%, about 67%, about 68%, about 69%, about 70%, about 71%, about 72%, about 73%, about 74%, about 75%, about 76%, about 77%, about 78%, about 79%, about 80%, about 81%, about 82%, about 83%, about 84%, about 85%, about 86%, about 87%, about 88%, about 89%, about 90%, about 91%, about 92%, about 93%, about 94%, about 95%, about 96%, about 97%, about 98%, or about 99%, inclusive of all ranges and subranges therebetween. In particular embodiments, the IR transmittance is greater than about 30%.

In still other embodiments, the ITVOF fabrics of the present disclosure have both an IR reflectance ranging from about 1% to about 25% and an IR transmittance ranging from about 60% to about 99%, including the ranges and subranges of each disclosed herein. In particular embodiments, the ITVOF fabrics of the present disclosure have an IR reflectance of less than about 10%, and an IR transmittance greater than about 60%.

Control Volume Analysis

The first component of the heat transfer model is to identify relevant control volumes (CV) and to apply an energy balance in order to obtain equations that connect the various heat transfer mechanisms included in this model. As shown in FIG. S1a, there are two control volumes that will be used in this study: CV1 is defined around only the human body and CV2 is defined around the entirety of the surrounding fabric. The expressions obtained when applying an energy balance around CV1 and CV2 are as follows, $$CV\ 1: q_{gen}+q_{rad,c}+\tau_c \cdot q_{rad,e}-(1-\rho_c)\cdot q_{rad,s}-q_{cond,a}=0 \quad \text{(S2)}$$

$$CV\ 2: (1-\rho_c-\tau_c)\cdot q_{rad,s}+(1-\rho_c-\tau_c)\cdot q_{rad,e}+q_{cond,a}-2\cdot q_{rad,c}-q_{conv}=0 \quad \text{(S3)}$$

where $q_{gen}$ is the heat generation rate per unit area, $q_{cond,a}$ is the conductive heat flux between the skin and the fabric, $q_{conv}$ is the convective heat flux from the fabric to the ambient environment, $q_{rad,s}$ is the radiative heat flux from the skin, $q_{rad,e}$ is the radiative heat flux from the ambient environment, and $q_{rad,c}$ is the radiative heat flux from the fabric. The conductive, convective, and radiative heat flux terms are expressed using Fourier's law, Newton's law of cooling, and the Stefan-Boltzmann law as follows, $$q_{cond,a} = k_a \cdot \frac{T_0 - T_1}{t_a} \tag{S4}$$

$$q_{conv} = h \cdot (T_2 - T_3) \tag{S5}$$

$$q_{rad,s} = \sigma T_0^4 \tag{S6}$$

$$q_{rad,e} = \sigma T_3^4 \tag{S7}$$

$$q_{rad,c} = \varepsilon_c \sigma \left(\frac{T_1 + T_2}{2}\right)^4 \tag{S8}$$

where $T_0$ is the skin temperature, $T_1$ is the inner surface fabric temperature, $T_2$ is the outer surface fabric temperature, $T_3$ is the ambient temperature, $k_a$ is the thermal conductivity of air, $t_a$ is the air gap thickness, h is the convective heat transfer coefficient, σ is the Stefan-Boltzmann constant equal to $5.67 \cdot 10^{-8}$ $Wm^{-2}K^{-4}$. In equation (S8), mean temperatures of $T_1$ and $T_2$ are assumed to approximate radiative emission by the fabric. Additionally, in equations (S2), (S3), (S6), and (S7), it was assumed the skin and environment behave like an ideal blackbody with an absorptance and emittance equal to 1.

Based on the control volume analysis, two fundamental equations (S2) and (S3) are obtained to describe the various contributions to heat transfer in this system. Since there are three unknowns that must be solved for, an additional equation is required in order to complete this model. Equations (S2) and (S3) describe heat transfer around the human body and the fabric, respectively. By deduction, the remaining equation must describe the nature of heat transfer within the fabric itself. Specifically, by considering heat conduction, radiative absorption, and radiative emission, a temperature profile can be derived in order to link the unknown temperatures $T_1$ and $T_2$.

Temperature Profile of Fabric

To determine the temperature profile within the fabric, heat conduction and radiative heat transfer must be included in the heat transfer analysis. If a differential volume element is taken within the fabric, as shown in FIG. S1b, the heat equation will take the following form, $$k_c \frac{\partial^2 T}{\partial x^2} - \frac{\partial}{\partial x}(q_{rad}) = 0 \tag{S9}$$

where $k_c$ is the fabric thermal conductivity and $q_{rad}$ is the net radiative transfer within the fabric. In general, $q_{rad}$ must be determined rigorously using the radiative heat transfer equation in order to account for all absorption, emission, and internal scattering processes. For simplicity, internal scattering effects are assumed to be negligible and only consider IR reflection at the boundaries of the fabric, as will be later shown when determining the expressions for each radiative heat flux. Additionally, self-absorption effects are also neglected. Therefore, the net radiative heat transfer will consist only of incident radiative absorption and outgoing radiative emission as follows, $$k_c \frac{\partial^2 T}{\partial x^2} = \frac{\partial}{\partial x}(q_{rad,cL'}) + \frac{\partial}{\partial x}(q_{rad,cR'}) + \frac{\partial}{\partial x}(q_{rad,s'}) + \frac{\partial}{\partial x}(q_{rad,e'}) \tag{S10}$$

where $q_{rad,cL'}$ is the radiative emission from the fabric to the skin, $q_{rad,cR'}$ is the radiative emission from the fabric to the ambient environment, $q_{rad,s'}$ is the absorption of radiation emitted from the skin, and $q_{rad,e'}$ is the absorption of radiation emitted from the ambient environment.

In general, the analytical form for radiative absorption and emission in the limit of negligible internal scattering will consist of an exponential decay in accordance to the Beer-Lambert law.[1] However, the analysis is simplified by instead assuming the absorption and emission profile to be linear as follows, $$q_{rad,i}(x) = A \cdot x + B \tag{S11}$$

where A and B are unknown coefficients that will depend on the boundary conditions assumed for each radiative heat flux. In the limit of high absorption, the approximation of a linear absorption and emission profile will be inaccurate. Despite this limitation, it is nonetheless expected that this approximation will provide a reasonable estimation of heat transfer through the fabric since the difference in the inner and outer fabric temperature is not expected to be large, thus inherently making this analysis less sensitive to the absorption and emission profile used. Using equation (S11) and appropriate boundary conditions for each radiative flux, the following is obtained, 1. Emission from fabric to skin:

$$q_{rad,cL'}(x = 0) = -q_{rad,c} \tag{S12}$$

$$q_{rad,cL'}(x = t_c) = 0 \qquad \rightarrow q_{rad,cL'}(x) = \frac{q_{rad,c}}{t_c} x - q_{rad,c}$$

2. Emission from fabric to ambient environment:

$$\begin{aligned} q_{rad,cR'}(x = 0) &= 0 \\ q_{rad,cR'}(x = t_c) &= q_{rad,c} \end{aligned} \rightarrow q_{rad,cR'}(x) = \frac{q_{rad,c}}{t_c} x \tag{S13}$$

3. Absorption by fabric from skin:

$$q_{rad,s'}(x = 0) = (1 - \rho_c) \cdot q_{rad,s} \tag{S14}$$

$$q_{rad,s'}(x = t_c) = \tau_c \cdot q_{rad,s} \qquad \rightarrow q_{rad,s'}(x) = -\frac{\alpha_c \cdot q_{rad,s}}{t_c} x + (1 - \rho_c \cdot q_{rad,s})$$

4. Absorption by fabric from ambient environment:

$$q_{rad,e'}(x = 0) = -\tau_c \cdot q_{rad,e} \tag{S15}$$

$$q_{rad,e'}(x = t_c) = -(1 - \rho_c) \cdot q_{rad,e} \qquad \rightarrow q_{rad,e'}(x) = -\frac{\alpha_c \cdot q_{rad,e}}{t_c} (x - t_c) - (1 - \rho_c) \cdot q_{rad,e}$$

Upon substituting equations (S12)-(S15) into (S10) and using the definition of heat fluxes defined by (S6)-(S8), the heat equation will become, $$\frac{\partial^2 T}{\partial x^2} = \frac{1}{k_c t_c}\left(2\varepsilon_c \sigma \left(\frac{T_1 + T_2}{2}\right)^4 - \alpha_c \sigma T_0^4 - \alpha_c \sigma T_3^4\right) \tag{S16}$$

where a mean temperature of $T_1$ and $T_2$ is again used to approximate radiative emission from the fabric. Although radiative emission from the fabric technically depends on the local temperature T as a function of position x, the use of a mean temperature is a reasonable approximation since $T_1$ and $T_2$ are not expected to be significantly different.

To determine the temperature profile, all that remains is to integrate equation (S16) and apply appropriate boundary conditions, $$\frac{\partial T}{\partial x} = \frac{1}{k_c t_c}\left(2\varepsilon_c\sigma\left(\frac{T_1+T_2}{2}\right)^4 - \alpha_c\sigma T_0^4 - \alpha_c\sigma T_3^4\right)x + C_1 \quad \text{(S17)}$$

$$T = \frac{1}{2k_c t_c}\left(2\varepsilon_c\sigma\left(\frac{T_1+T_2}{2}\right)^4 - \alpha_c\sigma T_0^4 - \alpha_c\sigma T_3^4\right)x^2 + C_1 x + C_2 \quad \text{(S18)}$$

The boundary conditions applied in this analysis includes temperature and heat flux continuity at surface 1 (x=0) as follows, $$T(x=0) = T_1 \quad \text{(S19)}$$

$$-k\frac{\partial T}{\partial x}(x=0) = q_{cond,a} \quad \text{(S20)}$$

Upon applying (S19) and (S20) in equations (S17) and (S18), the final expression is obtained for the temperature profile within the fabric, $$T = \frac{1}{2k_c t_c}\left(2\varepsilon_c\sigma\left(\frac{T_1+T_2}{2}\right)^4 - \alpha_c\sigma T_0^4 - \alpha_c\sigma T_3^4\right)x^2 - \frac{k_a}{k_c}\frac{(T_0-T_1)}{t_a}x + T_1 \quad \text{(S21)}$$

By taking $x=t_c$ in equation (S21), the following temperature relation is obtained, $$T_2 = \frac{t_c}{2k_c}\left(2\varepsilon_c\sigma\left(\frac{T_1+T_2}{2}\right)^4 - \alpha_c\sigma T_0^4 - \alpha_c\sigma T_3^4\right) - \frac{k_a t_c}{k_c t_a}(T_0 - T_1) + T_1 \quad \text{(S22)}$$

Therefore, with equations (S2), (S3), and (S22), there is now a complete set of equations to describe heat transfer from a human body covered by fabric to the ambient environment. These equations are used to first obtain the air gap thickness, $t_a$, for the previously described reference case with an assumed convective heat transfer coefficient. Following this calculation, the same equations are used to solve for $T_1$, $T_2$, and $T_3$ as a function of the fabric's optical properties and the assumed environmental conditions. From this analysis, one can find the maximum ambient temperature, $T_3$, which can be sustained without compromising personal thermal comfort.

Figure 22B:
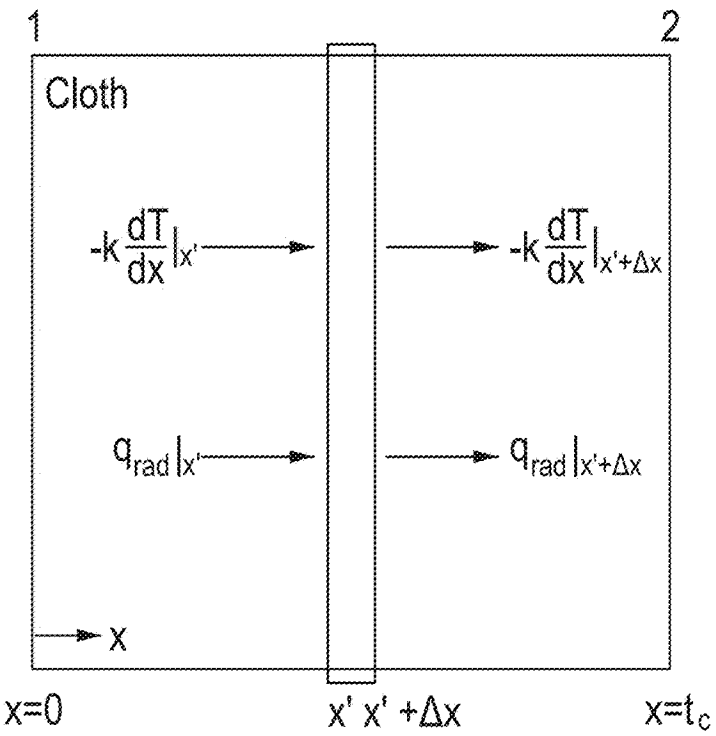
FIGS. 22A and 22B are illustrations depicting the control volume analysis and temperature profile formulation, respectively, for the heat transfer model.
Figure 22A:
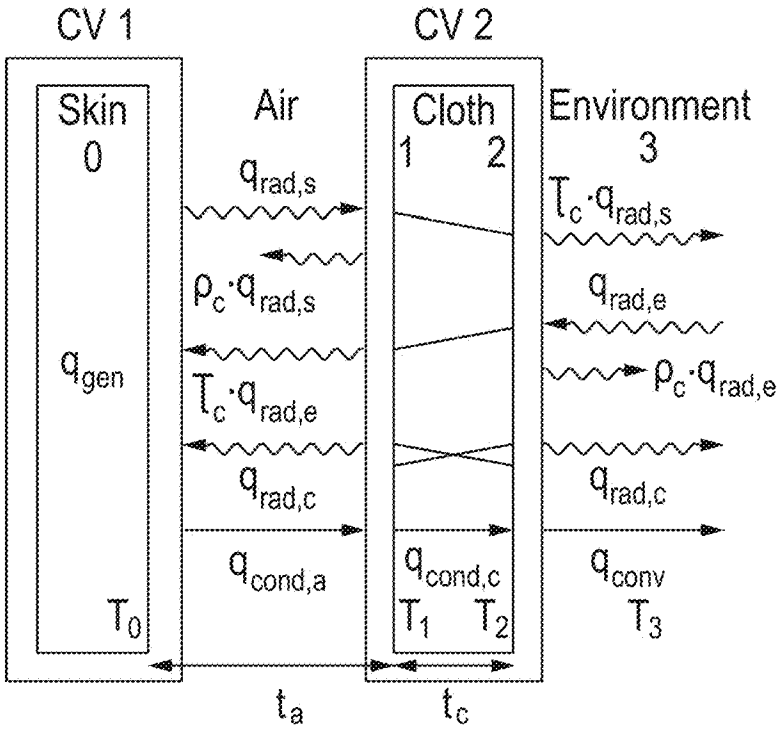

FIG. 22 shows illustrations depicting the control volume analysis and temperature profile formulation for the heat transfer model. (a) The control volumes chosen in this analysis consist of CV1 around the human body and CV2 around only the fabric. (b) A schematic illustrating the differential element and energy balance used to derive the temperature profile within the fabric. In addition to heat conduction, this analysis includes radiative absorption and emission.

Figure 23A:
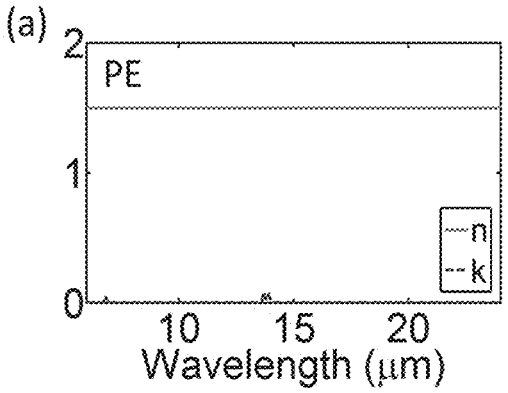
FIG. 23A shows the optical constants of polyethylene (PE) and FIG. 23B shows the optical constants of polyethylene terephthalate (PET), more commonly known as polyester, taken from the literature.
Figure 23B:
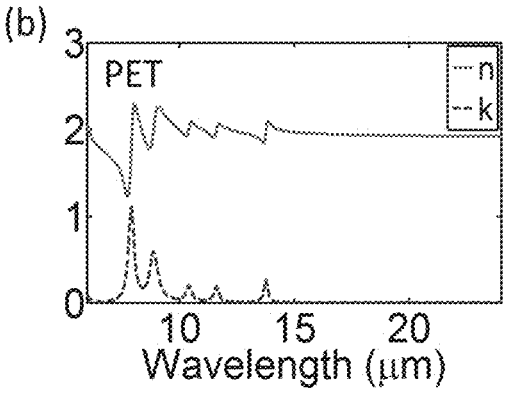

FIG. 23 shows the optical constants of: (a) polyethylene (PE) and (b) polyethylene terephthalate (PET), more commonly known as polyester, taken from the literature. For polyethylene, the refractive index, n, is extrapolated from shorter wavelength data. Based on the dispersion of the extinction coefficient, k, it is expected the refractive index will also exhibit some dispersion. However, this is assumed to be small and is thus neglected in this study. For polyester, a Lorentzian model was used to fit experimental data from previous studies.

Figure 24:
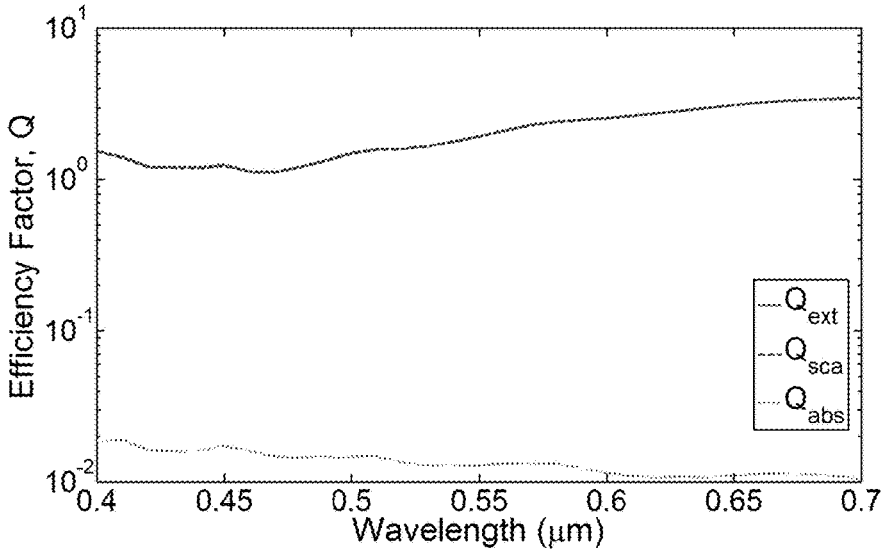
FIG. 24: The visible wavelength extinction, scattering, and absorption efficiency of a single polyethylene fiber.

FIG. 24 shows the visible wavelength extinction, scattering, and absorption efficiency of a single polyethylene fiber. The efficiency factor, Q, is defined as the ratio of the effective cross section normalized to the geometric cross section. The diameter of the fiber is D=1 μm and the incident light is assumed to be unpolarized. For computation, the standard Mie theory solutions for an infinitely long cylinder were used. As shown, the absorption efficiency exhibits a similar trend to the total hemispherical absorptance shown in FIG. 6 in the main text. The oscillatory behavior is indicative of whispering gallery modes supported by the fiber which are broadened due to material loss ($n=1.5$, $k=5\cdot10^{-4}$). In addition, a broad Fabry-Perot resonance is also supported by the fiber as indicated by the scattering efficiency, which increases from 460 nm to 700 nm.

Figure 25:
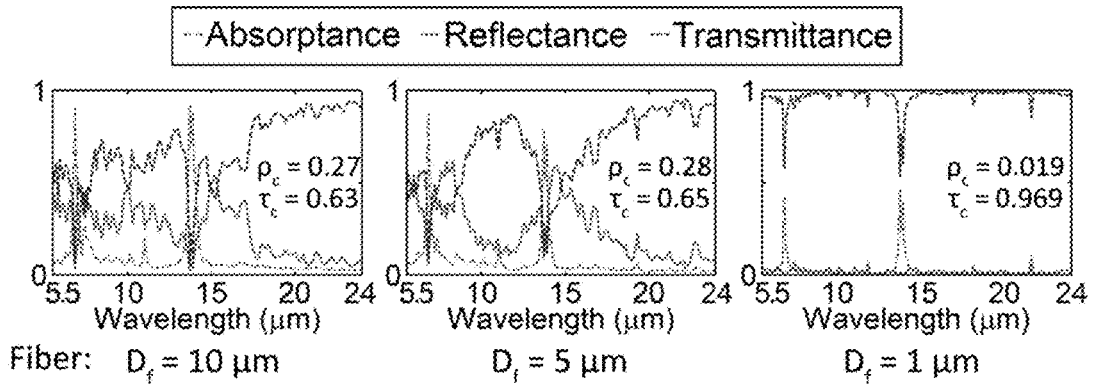
FIG. 25: Numerical simulation results for the IR optical properties of a polyethylene-based ITVOF for the case of a varying fiber diameter ($D_f$=1 μm, 5 μm, and 10 μm) assuming a fixed yarn diameter of $D_y$=50 μm.

FIG. 25 show numerical simulation results for the IR optical properties of a polyethylene-based ITVOF for the case of a varying fiber diameter ($D_f$=1 μm, 5 μm, and 10 μm) assuming a fixed yarn diameter of $D_y$=50 μm. As before, all simulations assume the fiber separation distance is $D_s$=1 μm and the yarn separation distance is $D_p$=5 μm. The spectrally integrated transmittance ($\tau_c$) and reflectance ($\rho_c$) is shown in each plot weighted by the Planck's distribution assuming a body temperature of 33.9° C. Compared to the case where $D_y$=30 μm, the overall transmittance is lower, as expected, due to the combination of a larger material volume that absorbs more incident IR radiation and a larger number of fibers available to scatter incident IR radiation thus increasing the reflectance. However, by reducing the size of the fiber to be $D_f$=1 μm, which is far smaller than IR wavelengths, the total transmittance can again be significantly enhanced from 0.63 to 0.969 which is nearly equal to the case where $D_y$=30 μm. Simultaneously, the reflectance of the ITVOF is reduced from 0.27 to 0.019 further improving radiative cooling. These results show that reducing the fiber size is far more important than reducing the yarn size. Therefore, this structuring methodology could potentially be applied to ITVOF that are comparable in size to conventional fabrics. The material volume per unit depth for a single yarn is 1492 $\mu m^2$ for $D_f$=10 μm, 1217 $\mu m^2$ for $D_f$=5 μm, and 445 $\mu m^2$ for $D_f$=1 μm. The optical properties of the ITVOF are again calculated for the wavelength range from 5.5 to 24 μm, which will provide a conservative estimate of the total transmittance and the reflectance.

Figure 26:
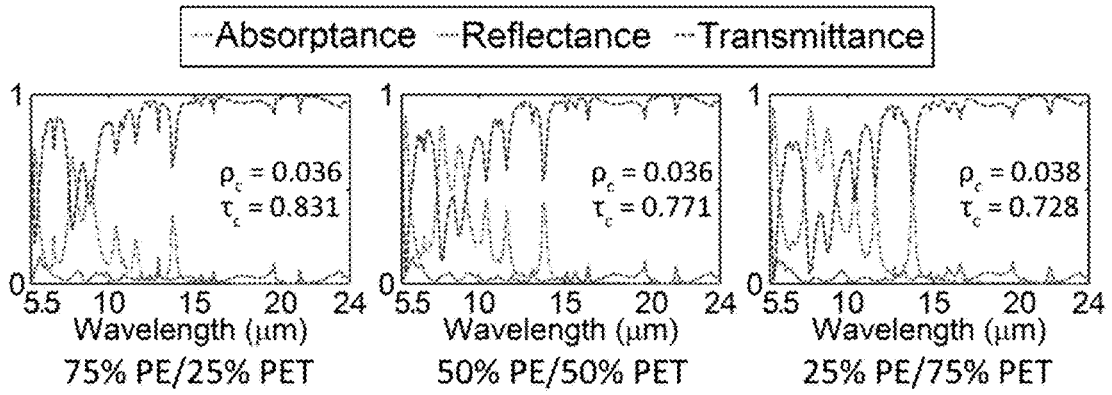
FIG. 26: Numerical simulation results for the IR optical properties of an ITVOF blend of polyethylene and polyester with varying volumetric concentrations.

FIG. 26 shows numerical simulation results for the IR optical properties of an ITVOF blend of polyethylene and polyester with varying volumetric concentrations. The PE and PET fibers were randomly distributed in the simulation. For all simulations it is assumed $D_f$=1 μm, $D_y$=30 μm, $D_s$=1 μm, and $D_p$=5 μm. Again, the spectrally integrated transmittance ($\tau_c$) and reflectance ($\rho_c$) is shown in each plot weighted by the Planck's distribution assuming a body temperature of 33.9° C. As shown, a progressive increase in the volumetric concentration of PET results in an increase in the spectral absorptance thus decreasing the total transmittance. However, it can also be observed that the spectral reflectance is ~0.04 for all cases and exhibits no significant variation spectrally further reinforcing the point that so long as the fiber is sufficiently small compared to IR wavelengths, scattering will be minimal. Based on these results, even the highest volumetric concentration of PET fibers (25% PE/75% PET) can provide sufficient cooling to raise the ambient temperature to 26.1° C. due to a combination of a high total transmittance of 0.728 and a low total reflectance of 0.038. The material volume per unit depth for a single yarn in all cases is equal to 135.9 $\mu m^2$. The optical properties of the ITVOF are again calculated for the wavelength range from 5.5 μm to 24 μm, which will provide a conservative estimate of the total transmittance and the reflectance.

Each document cited herein is incorporated in its entirety for all purposes.

We claim:

1. A radiative cooling fabric comprising woven yarn, wherein the woven yarn substantially comprises fibers having a diameter of about 1 μm, and the average separation between yarn ranges from about 3 μm to about 100 μm.

2. The radiative cooling fabric of claim 1, wherein the average separation between the fibers ranges from about 3 μm to about 10 μm.

3. The radiative cooling fabric of claim 1, wherein the IR transmittance at wavelengths between about 5 μm to about 30 μm ranges from about 30% to about 90%, and the visible reflectance between about 300 nm to about 800 nm ranges from about 40% to about 60%.

4. The radiative cooling fabric of claim 1, wherein the fabric has a porosity of about 0.1 to about 0.2.

5. The radiative cooling fabric of claim 1, wherein the yarn has an average diameter ranging from about 30 μm to about 300 μm.

6. The radiative cooling fabric of claim 1, wherein the fibers comprise polyester, cellulose, cellulose acetate, polyethylene, polypropylene, or nylon.

7. The radiative cooling fabric of claim 1, wherein the fibers consist essentially of one polymer.

8. The radiative cooling fabric of claim 6, wherein the fibers comprise 2 or more polymers.

9. The radiative cooling fabric of claim 8, wherein the fibers have a core-sheath structure.

10. The radiative cooling fabric of claim 1, wherein the yarn comprises fibers of polyester, cellulose, cellulose acetate, polyethylene, polypropylene, or nylon.

11. The radiative cooling fabric of claim 1, wherein the yarn comprises fibers having substantially the same composition.

12. The radiative cooling fabric of claim 1, wherein the yarn comprises 2 or more types of fibers.

13. The radiative cooling fabric of claim 1, wherein the fabric comprises 2 or more types of yarns.

14. The radiative cooling fabric of claim 1, further comprising at least one dye.

15. A garment comprising the fabric of claim 1.

16. The garment of claim 15, further comprising at least one dye.

* * * * *